US010001743B2

(12) United States Patent
Komiyama et al.

(10) Patent No.: US 10,001,743 B2
(45) Date of Patent: Jun. 19, 2018

(54) POWDER COLLECTION DEVICE AND PROCESSING APPARATUS USING THE SAME

(71) Applicant: FUJI XEROX CO., LTD., Tokyo (JP)

(72) Inventors: Tsutomu Komiyama, Kanagawa (JP); Kohyu Shigemori, Kanagawa (JP); Taro Mitsui, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/209,926

(22) Filed: Jul. 14, 2016

(65) Prior Publication Data

US 2017/0269539 A1 Sep. 21, 2017

(30) Foreign Application Priority Data

Mar. 15, 2016 (JP) ..... 2016-050370

(51) Int. Cl.
*G03G 21/10* (2006.01)

(52) U.S. Cl.
CPC ..... *G03G 21/105* (2013.01)

(58) Field of Classification Search
CPC ..... G03G 21/10
See application file for complete search history.

(56) References Cited

U.S. PATENT DOCUMENTS

2004/0062064 A1* 4/2004 Pelly ..... H02M 1/126 363/100
2011/0293301 A1* 12/2011 Hayakawa ..... G03G 15/1605 399/44
2012/0027436 A1* 2/2012 Maruyama ..... G03G 15/0291 399/31
2013/0077994 A1* 3/2013 Takiguchi ..... G03G 21/1647 399/123

(Continued)

FOREIGN PATENT DOCUMENTS

JP 08278674 A * 10/1996
JP 2002169441 A * 6/2002
JP 2008009460 A * 1/2008

(Continued)

OTHER PUBLICATIONS

JP_2002169441_A_T Mashine translation Sato Japan 2002.*

*Primary Examiner* — Victor Verbitsky
(74) *Attorney, Agent, or Firm* — Sughrue Mion, PLLC

(57) ABSTRACT

A powder collection device includes a transport pipe, a powder collection container supported turnably on a pivot center provided in an attachment part of an apparatus body and removably attached to a position to cover an attachment part of the apparatus body, a pipe-side opening/closing mechanism that opens a discharging port by moving an opening/closing lid in cooperation with an operating member of the powder collection container when the powder collection container is turned to the position to cover the attachment part, and a container-side opening/closing (Continued)

mechanism that opens a collection port by moving a container opening/closing lid in cooperation with an operating member of the transport pipe when the powder collection container is turned to the position to cover the attachment part. The discharging port is disposed on a side of a vertical line including the pivot center different from the apparatus body.

12 Claims, 21 Drawing Sheets

(56) References Cited

U.S. PATENT DOCUMENTS

| | | | | |
|---|---|---|---|---|
| 2014/0376963 | A1 | 12/2014 | Suzuki | |
| 2015/0023708 | A1* | 1/2015 | Lee | G03G 21/105 399/358 |

FOREIGN PATENT DOCUMENTS

| | | | |
|---|---|---|---|
| JP | 2008-216278 | A | 9/2008 |
| JP | 2015-004931 | A | 1/2015 |

* cited by examiner

POWDER COLLECTION DEVICE AND PROCESSING APPARATUS USING THE SAME

CROSS-REFERENCE TO RELATED APPLICATIONS

This application is based on and claims priority under 35 USC 119 from Japanese Patent Application No. 2016-050370 filed Mar. 15, 2016.

BACKGROUND

Technical Field

The present invention relates to a powder collection device and a processing apparatus using the powder collection device.

SUMMARY

According to an aspect of the invention, there is provided a powder collection device including a transport pipe that transports collected powder produced in an apparatus body having a powder processing unit, a powder collection container having, therein, a powder receiving chamber that receives the collected powder, supported turnably on a pivot center provided in a lower edge portion of an attachment part of the apparatus body, and removably attached to a position to cover the attachment part of the apparatus body, a pipe-side opening/closing mechanism having an opening/closing lid that linearly moves to open and close a discharging port provided on a lower side of the transport pipe near a protruding end in a longitudinal direction along the longitudinal direction, the pipe-side opening/closing mechanism opening the discharging port by moving the opening/closing lid at the discharging port in cooperation with an operating member provided in the powder collection container when the powder collection container is turned to the position to cover the attachment part of the apparatus body, and a container-side opening/closing mechanism having a container opening/closing lid that linearly moves to open and close a collection port provided in a predetermined receiving portion of the powder collection container along the longitudinal direction, the container-side opening/closing mechanism opening the collection port by moving the container opening/closing lid in cooperation with an operating member provided in the transport pipe when the powder collection container is turned to the position to cover the attachment part of the apparatus body. The discharging port of the pipe-side opening/closing mechanism is disposed on a side of a vertical line including the pivot center of the powder collection container different from the apparatus body.

BRIEF DESCRIPTION OF THE DRAWINGS

Exemplary embodiments of the present invention will be described in detail based on the following figures, wherein:

FIG. 1A illustrates a state before a powder collection container is attached to an apparatus body, and FIG. 1B illustrates a state after the powder collection container is attached to the apparatus body;

FIG. 2A illustrates a state before a powder collection container is attached to an apparatus body, and FIG. 2B illustrates a state after the powder collection container is attached to the apparatus body;

DETAILED DESCRIPTION

Outline of Exemplary Embodiments

Figure 1A:
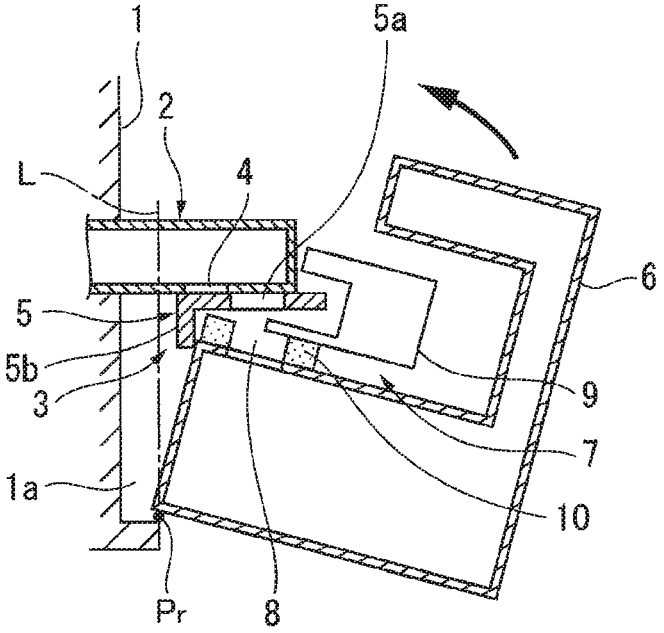
FIGS. 1A and 1B are explanatory views illustrating an outline of a powder collection device according to an exemplary embodiment of the present invention.
Figure 1B:
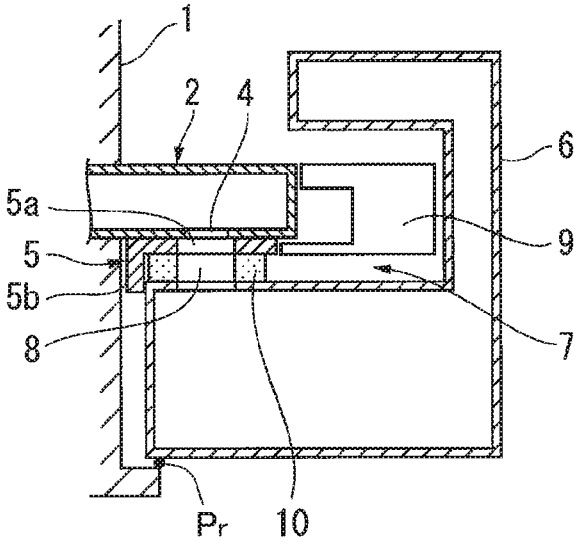

FIGS. 1A and 1B are explanatory views illustrating an outline of a powder collection device according to an exemplary embodiment of the present invention, FIG. 1A illustrates a state before a powder collection container is attached to an attachment part of an apparatus body to be described later, and FIG. 1B illustrates a state after the powder collection container is attached to the apparatus body.

Referring to FIGS. 1A and 1B, the powder collection device includes a transport pipe 2, a powder collection container 6, a pipe-side opening/closing mechanism 3, and a container-side opening/closing mechanism 7. The transport pipe 2 transports collected powder produced in an apparatus body 1 including a powder processing unit. The powder collection container 6 has, therein, a powder receiving chamber that receives the collected powder, is supported turnably on a pivot center Pr provided in a lower edge portion of an attachment part 1*a* in the apparatus body 1, and is removably attached to a position to cover the attachment part 1*a* of the apparatus body 1. The pipe-side opening/closing mechanism 3 has an opening/closing lid 5 that linearly moves to open and close a discharging port 4, which is provided on a lower side of the transport pipe 2 near a protruding end in a longitudinal direction, along the longitudinal direction. The pipe-side opening/closing mechanism 3 opens the discharging port 4 by moving the opening/closing lid 5 at the discharging port 4 in cooperation with an operating member provided in the powder collection container 6 when the powder collection container 6 is turned to the position to cover the attachment part 1*a* of the apparatus body 1. The container-side opening/closing mechanism 7 has a container opening/closing lid 9 that linearly moves to open and close a collection port 8, which is provided in a predetermined receiving portion of the powder collection container 6, along the longitudinal direction. The container-side opening/closing mechanism 7 opens the collection port 8 by moving the container opening/closing lid 9 in cooperation with an operating member provided in the transport pipe 2 when the powder collection container 6 is turned to the position to cover the attachment part 1*a* of the apparatus body 1. The discharging port 4 of the pipe-side opening/closing mechanism 3 is disposed on a side of a vertical line L including the pivot center Pr of the powder collection container 6 different from the apparatus body 1.

Here, the expression "disposed on a side of a vertical line L different from the apparatus body 1" includes acceptable ranges of errors in component accuracy, assembly accuracy, and so on, and the transport pipe 2 may be inclined somewhat.

While the collected powder is not particularly limited as long as it is transported in the transport pipe 2, a typical example of collected powder is waste developer used in an image forming apparatus. The number of transport pipes 2 provided in the apparatus body 1 is not particularly limited, and a single transport pipe 2 may be provided or plural transport pipes 2 may be provided. Further, it is only necessary that the cross-sectional shape of the transport pipe 2 should be such as to transport collected powder, and the outer shape of the transport pipe 2 may be, for example, circular or rectangular. The pivot center Pr on which the powder collection container 6 is turned when attached to the attachment part 1*a* of the apparatus body 1 is provided in the lower edge portion of the attachment part 1*a*, and includes plural positions in the lower edge portion. The plural positions may be used, for example, in a dotted form or a linear form.

To properly perform the operation of opening the opening/closing lid 5 in the pipe-side opening/closing mechanism 3, for example, the opening/closing lid 5 in the pipe-side opening/closing mechanism 3 includes a communicating port 5*a* that is larger than the discharging port 4 and smaller than the collection port 8 of the powder collection container 6 and communicates between the discharging port 4 and the collection port 8 when the discharging port 4 is opened, and an arm portion 5*b* that projects downward on a side closer to the apparatus body 1 than the communicating port 5*a*. For example, when the powder collection container 6 is attached to the attachment part 1*a*, the operating member (not illustrated) provided in the powder collection container 6 first comes into contact with the arm portion 5*b*. In this case, when the powder collection container 6 turns, the operating member in the powder collection container 6 comes into contact with the arm portion 5*b* of the opening/closing lid 5. Thus, the powder collection container 6 does not directly touch an end portion of the opening/closing lid 5, and this may allow the opening/closing lid 5 to be opened stably.

Further, the powder collection container 6 may include an elastic member 10 that is elastically deformable along a peripheral edge of the collection port 8. The shape of the collection port 8 is not particularly limited, and it is only necessary that the shape of the collection port 8 should allow collection of the collected powder.

Figure 2A:
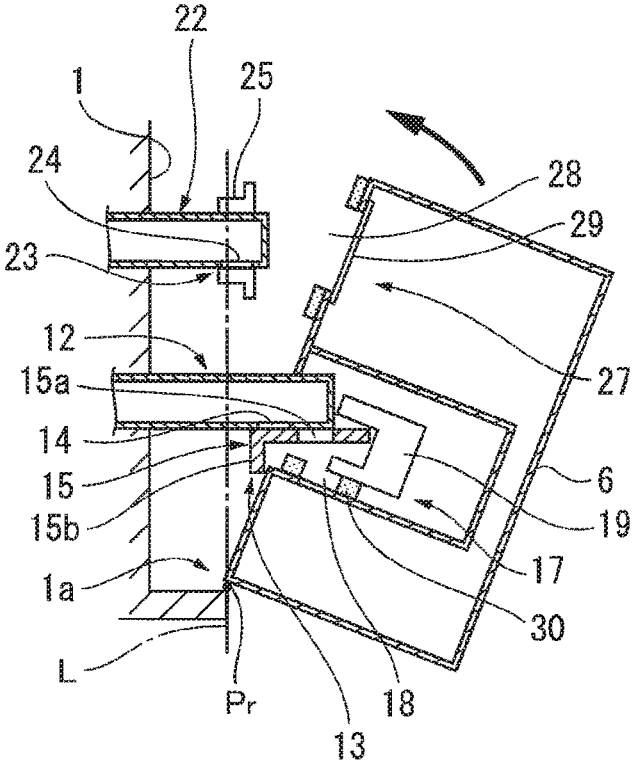
FIGS. 2A and 2B are explanatory views illustrating an outline of a powder collection device according to another exemplary embodiment of the present invention.
Figure 2B:
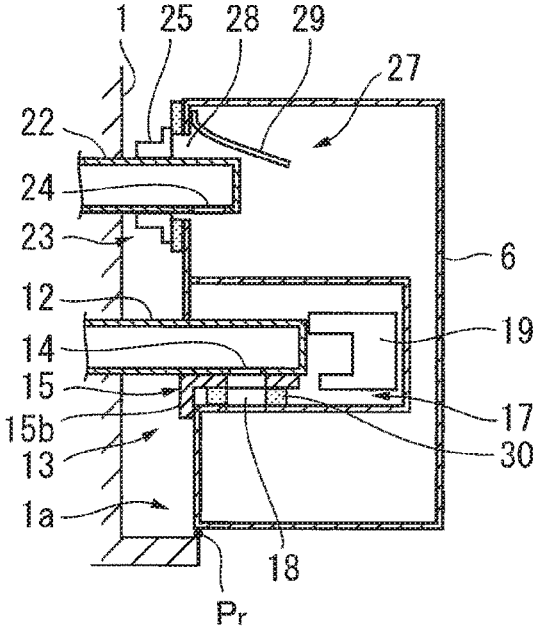

FIGS. 2A and 2B are explanatory views illustrating a powder collection device according to another exemplary embodiment, FIG. 2A illustrates a state before a powder collection container is attached to an attachment part of an apparatus body, and FIG. 2B illustrates a state after the powder collection container is attached to the apparatus body.

Referring to FIGS. 2A and 2B, the powder collection device includes a first transport pipe 12, a second transport pipe 22, and a powder collection container 6. The first transport pipe 12 transports collected powder produced in an apparatus body 1 including a powder processing unit. The second transport pipe 22 is disposed above the first transport pipe 12, and transports collected powder produced in the apparatus body 1 including the powder processing unit. The powder collection container 6 has, therein, a powder receiving chamber that receives the collected powder, is supported turnably on a pivot center Pr provided in a lower edge portion of an attachment part 1*a* of the apparatus body 1, and is removably attached to a position to cover the attachment part 1*a* of the apparatus body 1. The powder collection device further includes a first pipe-side opening/closing mechanism 13, a second pipe-side opening/closing mechanism 23, a first container-side opening/closing mechanism 17, and a second container-side opening/closing mechanism 27. The first pipe-side opening/closing mechanism 13 includes a first opening/closing lid 15 that linearly moves to open and close a first discharging port 14, which is provided on a lower side of the first transport pipe 12 near a protruding end in a longitudinal direction, along the longitudinal direction. The first pipe-side opening/closing mechanism 13 opens the first discharging port 14 by moving the first opening/closing lid 15 in cooperation with an operating member provided in the powder collection container 6 when the powder collection container 6 is turned to the position to cover the attachment part 1*a* of the apparatus body 1. The second pipe-side opening/closing mechanism 23 includes a second opening/closing lid 25 that moves along an outer periphery of the second transport pipe 22 to open and close a second discharging port 24, which is provided on a lower side of the second transport pipe 22 near a protruding end in the longitudinal direction, along the longitudinal direction. The second pipe-side opening/closing mechanism 23 opens the second discharging port 24 by moving the second opening/closing lid 25 in cooperation with an operating member provided in the powder collection container 6 when the powder collection container 6 is turned to the position to cover the attachment part 1*a* of the apparatus body 1. The first container-side opening/closing mechanism 17 includes a first container opening/closing lid 19 that linearly moves to open and close a first collection port 18 provided in a predetermined receiving portion of the powder collection container 6 along the longitudinal direction. The first container-side opening/closing mechanism 17 opens the first collection port 18 by moving the first container opening/closing lid 19 in cooperation with an operating member provided in the first transport pipe 12 when the powder collection container 6 is turned to the position to cover the attachment part 1*a* of the apparatus body 1. The second container-side opening/closing mechanism 27 includes a second container opening/closing lid 29 that opens and closes a second collection port 28 provided in a predetermined receiving portion above the first container-side opening/closing mechanism 17 of the powder collection container 6. The second container-side opening/closing mechanism 27 opens the second collection port 28 by moving the second container opening/closing lid 29 in cooperation with an operating member provided in the second transport pipe 22 when the powder collection container 6 is turned to the position to cover the attachment part 1*a* of the apparatus body 1. The first discharging port 14 in the first pipe-side opening/closing mechanism 13 is disposed on a side of a vertical line L including a pivot center Pr of the powder collection container 6 different from the apparatus body 1.

Here, the numbers of first and second transport pipes 12 and 22 are not particularly limited. For example, when collected powder is developer, the numbers of first and second transport pipes 12 and 22 each correspond to four colors used in the image forming apparatus. The second opening/closing lid 25 moves along the outer periphery of the second transport pipe 22, and is ring-shaped as an example.

The positions of the first discharging port 14 and the second discharging port 24 in the vertical direction are not particularly limited. The first discharging port 14 and the second discharging port 24 may be disposed at an aligned position or at different positions. It is only necessary that the first discharging port 14 should be disposed on the side of the vertical line L including the pivot center Pr different from the apparatus body 1. In this exemplary embodiment, the first pipe-side opening/closing mechanism 13 (provided on the lower side) and the second pipe-side opening/closing mechanism 23 (provided on the upper side) using different opening/closing systems are arranged in the up-down direction. The upper second pipe-side opening/closing mechanism 23 adopts an inexpensive opening/closing system. In contrast, in an opening/closing system of the lower first pipe-side opening/closing mechanism 13, even when collected powder leaks from the second pipe-side opening/closing mechanism 23, the leaking collected powder does not affect the first opening/closing lid 15 of the first pipe-side opening/closing mechanism 13 because the first opening/closing lid 15 is provided on the lower surface of the first transport pipe 12.

From the viewpoint of preventing scattering of the collected powder from the second discharging port 24 from affecting the first discharging port 14, the second discharging port 24 is disposed at a position out of a region occupied by the first discharging port 14 in the vertical direction. In this case, for example, the second discharging port 24 may be disposed on a side closer to the apparatus body 1 than the region occupied by the first discharging port 14 in the vertical direction, or may be disposed on a side different from the apparatus body 1. Further, from the viewpoint of suppressing scattering of the collected powder in the second pipe-side opening/closing mechanism 23, the second discharging port 24 is disposed on the vertical line L including the pivot center Pr.

To properly perform the operation of opening the first opening/closing lid 15 of the first pipe-side opening/closing mechanism 13, for example, the first opening/closing lid 15 includes a communicating port 15*a* that is larger than the first discharging port 14 and smaller than the first collection port 18 of the powder collection container 6 and that communicates between the first discharging port 14 and the first collection port 18 when the first discharging port 14 is opened, and an arm portion 15*b* projecting downward on a side closer to the apparatus body 1 than the communicating port 15*a*. When the powder collection container 6 is attached to the attachment part 1*a*, the operating member (not illustrated) provided in the powder collection container 6 first comes into contact with the arm portion 15*b*. In this case, since the operating member of the powder collection container 6 comes into contact with the arm portion 15*b* of the first opening/closing lid 15 when the powder collection container 6 is turned, the powder collection container 6 does not touch an end portion of the first opening/closing lid 15, and this may allow the first opening/closing lid 15 to be opened stably.

The powder collection container 6 may include an elastically deformable elastic member 30 that projects along a peripheral edge of the first collection port 18. The shape of the first collection port 18 is not particularly limited, and may be any shape as long as it allows collection of collected powder.

To apply this powder collection device to a processing apparatus that processes collected powder, the processing apparatus includes a powder processing unit provided in the apparatus body 1 to process powder and a powder collection device that collects processed collected powder processed by the powder processing unit. As the powder collection device, the above-described powder collection device is used. A typical example of such a processing apparatus is configurated to collect collected powder into the powder collection container 6 after the collected powder is processed.

An image forming apparatus is adopted as the processing apparatus as follows. That is, the powder processing unit includes an image bearing member that bears an electrostatic latent image, a developing device that develops the electrostatic latent image on the image bearing member with developer serving as powder, a transfer device that transfers a visible image developed by the developing device onto a recording material, and a cleaning device that cleans off residual developer remaining on the image bearing member. The powder collection device collects waste developer (corresponding to the collected powder) discharged from at least one of the developing device, the transfer device, and the cleaning device. Typical examples of such a processing apparatus include a developing device and an image forming apparatus using developer as powder.

The present invention will be described in more detail with reference to exemplary embodiments illustrated in the attached drawings.

First Exemplary Embodiment

Figure 3:
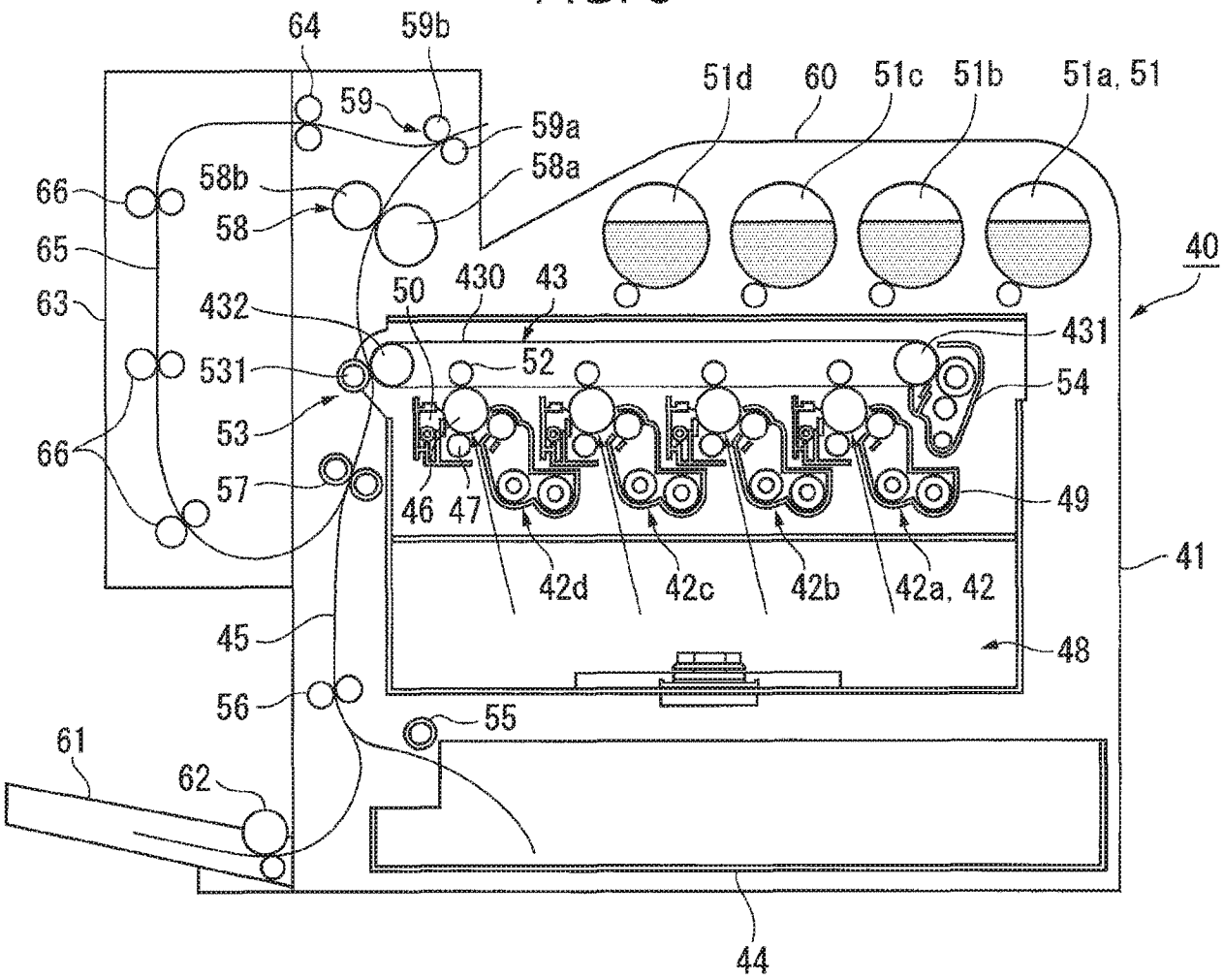
FIG. 3 is an explanatory view illustrating an outline of an image forming apparatus according to a first exemplary embodiment.

FIG. 3 is an explanatory view illustrating an outline of an image forming apparatus serving as a processing apparatus according to a first exemplary embodiment. Referring to FIG. 3, in an image forming apparatus 40, image forming units 42 (42*a* to 42*d*) corresponding to four colors (black, yellow, magenta, and cyan in the first exemplary embodiment) are arranged in a substantially horizontal direction inside an apparatus housing 41. A transfer module 43 (corresponding to the transfer device) is provided above the image forming units 42, and includes an intermediate transfer belt 430 to be circularly transported in an arrangement direction of the image forming units 42. In a lower part of the apparatus housing 41, a recording-material supply device 44 that stores recording materials, such as paper, is provided, and a recording-material transport path 45 extends from the recording-material supply device 44 in a substantially vertical direction.

The image forming units 42 (42*a* to 42*d*) form, for example, black, yellow, magenta, and cyan toner images, respectively, in order from the upstream side in the circling direction of the intermediate transfer belt 430 (the arrangement order is not always limited to this order). Each of the image forming units 42 includes a photoconductor 46 serving as an image bearing member, a charging device (charging roller in the first exemplary embodiment) 47 that charges the photoconductors 46 beforehand, an exposure device 48 that writes an electrostatic latent image on the photoconductor 46 charged by the charging device 47 (in the first exemplary embodiment, an exposure device common to the image forming units 42 is used), a developing device 49 that develops the electrostatic latent image formed on the photoconductor 46 with corresponding color toner, and a cleaning device 50 that cleans residues off the photoconductor 46. Toner cartridges 51 (51*a* to 51*d*) each supply color component toner to the corresponding developing device 49.

In the first exemplary embodiment, the transfer module 43 is formed, for example, by stretching an intermediate transfer belt 430 between a pair of stretching rollers 431 and 432 (one of them is a driving roller). A first transfer device 52 (a first transfer roller in the first exemplary embodiment) is provided on the back side of the intermediate transfer belt 430 correspondingly to the photoconductor 46 in each of the image forming units 42, and first-transfers a toner image on the photoconductor 46 onto the intermediate transfer belt 430. Further, a second transfer device 53 is provided at a position corresponding to the stretching roller 432 on the intermediate transfer belt 430, and second-transfers (collectively transfers) first transfer images on the intermediate transfer belt 430 onto a recording material. The second transfer device 53 includes a second transfer roller 531 disposed in pressure contact with a toner-image bearing surface of the intermediate transfer belt 430, and a backup roller (formed by the stretching roller 432 in the first exemplary embodiment) disposed on the back side of the intermediate transfer belt 430 to form a counter electrode opposed to the second transfer roller 531. On an upstream side of the image forming unit 42*a* in the rotating direction of the intermediate transfer belt 430, a belt cleaning device 54 is provided to clean residual toner off the intermediate transfer belt 430.

The recording-material supply device 44 is provided with a supply roller 55 that supplies recording materials. A transport roller 56 is provided just after the supply roller 55 to transport the recording materials. A positioning roller (registration roller) 57 is disposed in the recording-material transport path 45 just short of a second transfer portion to supply the recording materials to the second transfer portion at a predetermined timing.

On the other hand, a fixing device 58 is provided in the recording-material transport path 45 located on the downstream side of the second transfer portion, and is formed by a combination of a heating roller 58*a* and a pressurizing roller 58*b* in the first exemplary embodiment. On the downstream side of the fixing device 58, a recording-material output device 59 is provided. The recording-material output device 59 is composed of a pair of output rollers 59*a* and 59*b*, nips and transports a recording material, and outputs the recording material into a recording-material receiver 60 provided in the upper part of the apparatus housing 41.

Further, in the first exemplary embodiment, a manual supply device 61 is provided on a side of the apparatus housing 41. A recording material on the manual supply device 61 is supplied toward the recording-material transport path 45 by a supply roller 62. The apparatus housing 41 is also provided with a duplex recording module 63. When a duplex mode for recording images on both surfaces of a recording material is selected, the duplex recording module 63 reverses the recording-material output device 59, takes in a recording material having one recorded surface by a guide roller 64 at a position short of the entrance, transports the recording material by plural transport rollers 66 along an internal recording-material return transport path 65, and supplies the recording material to the positioning roller 57 again.

Regarding Waste Developer

In the image forming apparatus 40 having the above-described configuration according to the first exemplary embodiment, waste developer is collected from three systems, that is, the developing device 49, the cleaning device 50, and the belt cleaning device 54. Accordingly, the following waste developer is collected from these devices:

(1) In the developing device 49 of each of the image forming units 42 (42*a* to 42*d*) of the first exemplary embodiment, two-component developer containing toner and carriers is used, the developer inside a developing container is charged while being agitated and transported by an agitating transport member, and an electrostatic latent image on the photoconductor 46 is developed using a developing roller. At this time, the toner is mostly consumed in the developer. Thus, the carries in the developer are hardly consumed, but remain. If the carriers get old, there is a fear that, for example, charging characteristics of the developer may be impaired. To remove this fear, in the first exemplary embodiment, old developer is periodically discharged as waste developer from the developing device 49 to the outside.

(2) The cleaning device 50 of the first exemplary embodiment cleans off toner remaining on the photoconductor 46. Developer (mostly waste toner) collected in the cleaning device 50 is discharged from the cleaning device 50 to the outside.

(3) The belt cleaning device 54 cleans off developer (mostly waste toner) remaining on the intermediate transfer belt 430. Waste toner collected in the belt cleaning device 54 is discharged from the belt cleaning device 54 to the outside.

Discharging Paths of Waste Developer and Waste Toner

Figure 4:
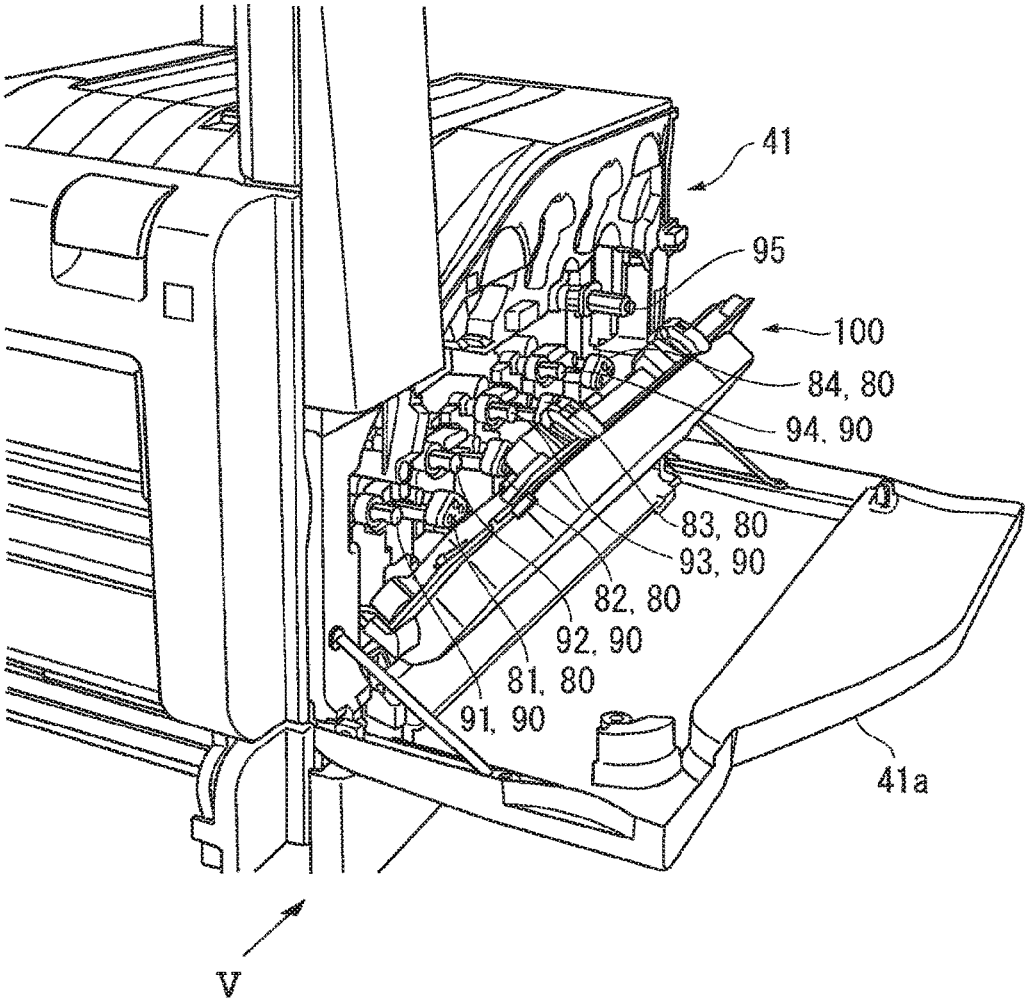
FIG. 4 is a perspective view illustrating a discharging path of waste developer in the first exemplary embodiment.
Figure 5:
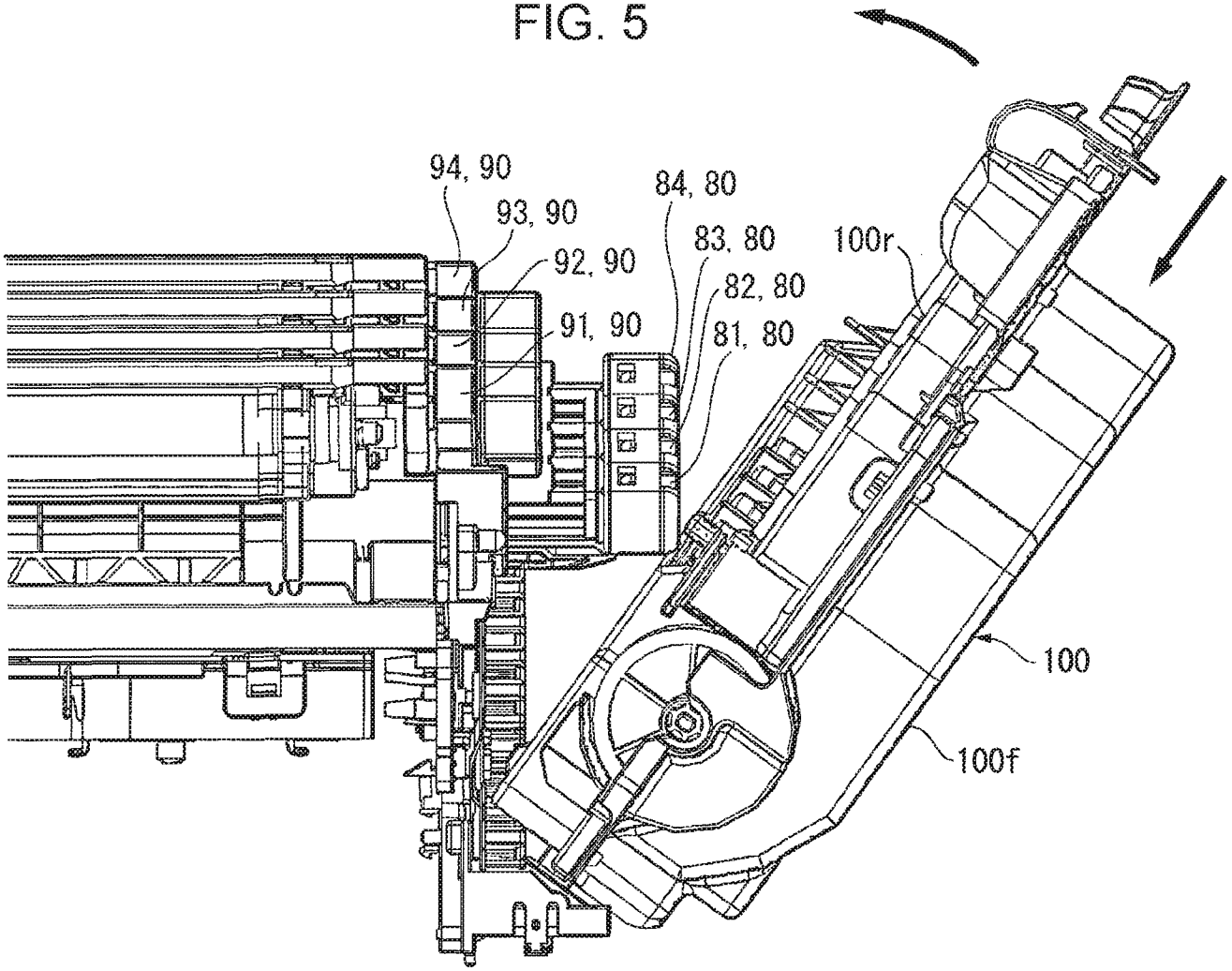
FIG. 5 is a perspective view from a V-direction of FIG. 4.

Next, a description will be given of discharging paths of waste developer (corresponding to the collected powder in the first exemplary embodiment) in the first exemplary embodiment. FIGS. 4 and 5 are perspective views illustrating discharging paths of waste developer in the first exemplary embodiment, and FIG. 5 is a view from V-direction of FIG. 4.

In the first exemplary embodiment, waste developer from the above-described three systems passes through different paths, and is collected in a collection container 100 serving as a powder collection container. Waste developer from the image forming units 42 (42*a* to 42*d*) is transported toward the collection container 100 via waste-developer discharging devices 80 (81 to 84), and waste toner from the cleaning devices 50 is transported toward the collection container 100 via waste-toner discharging devices 90 (91 to 94). Further, waste toner is transported from the belt cleaning device 54 via a waste-toner discharging device 95 having a structure substantially similar to that of the waste-toner discharging devices 90.

The waste-developer discharging devices 81 to 84 of the first exemplary embodiment are juxtaposed along the V-direction in a slightly upward oblique direction. The waste-toner discharging devices 91 to 94 are disposed above the waste-developer discharging devices 81 to 84, and are juxtaposed along the V-direction in a slightly upward oblique direction, similar to the waste-developer discharging devices 81 to 84. Further, the waste-toner discharging device 95 is disposed above the waste-toner discharging devices 90. The waste-developer discharging devices 80, the waste-toner discharging devices 90, and the waste-toner discharging device 95 are disposed at the positions corresponding to arrangement of the developing devices 49, the cleaning devices 50, and the belt cleaning device 54. In FIGS. 4 and 5, a front case 100*f* of the collection container 100 is located on the front side of the apparatus housing 41, and a rear case 100*r* is located on the back side of the front case 100*f*.

Waste-Developer Discharging devices

Figure 6:
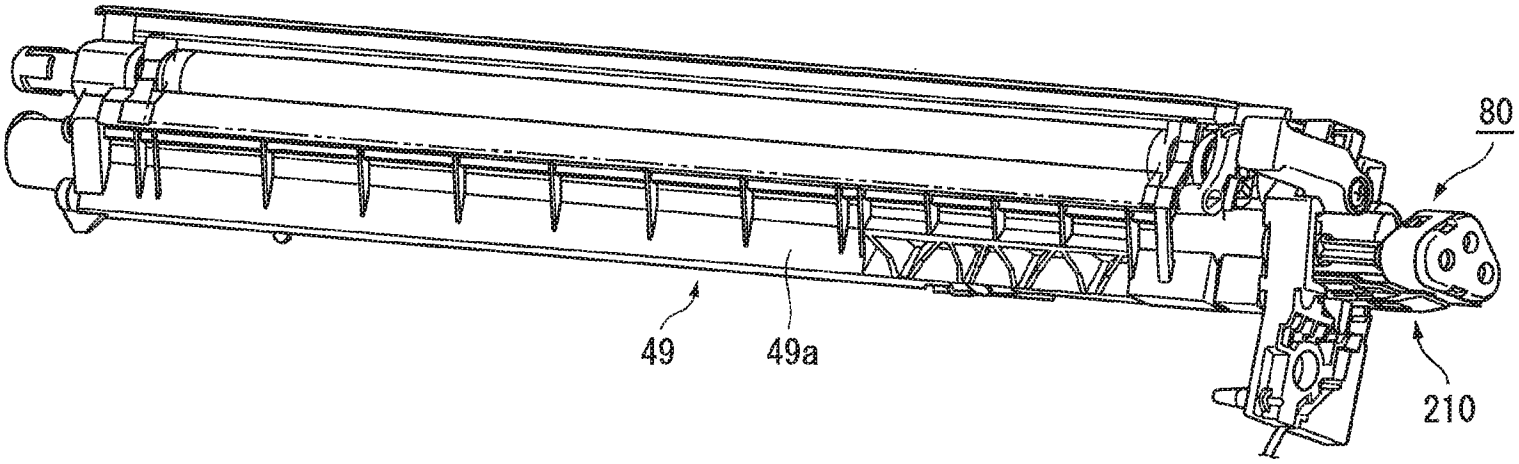
FIG. 6 is a perspective view of a waste-developer discharging device in the first exemplary embodiment.
Figure 7:
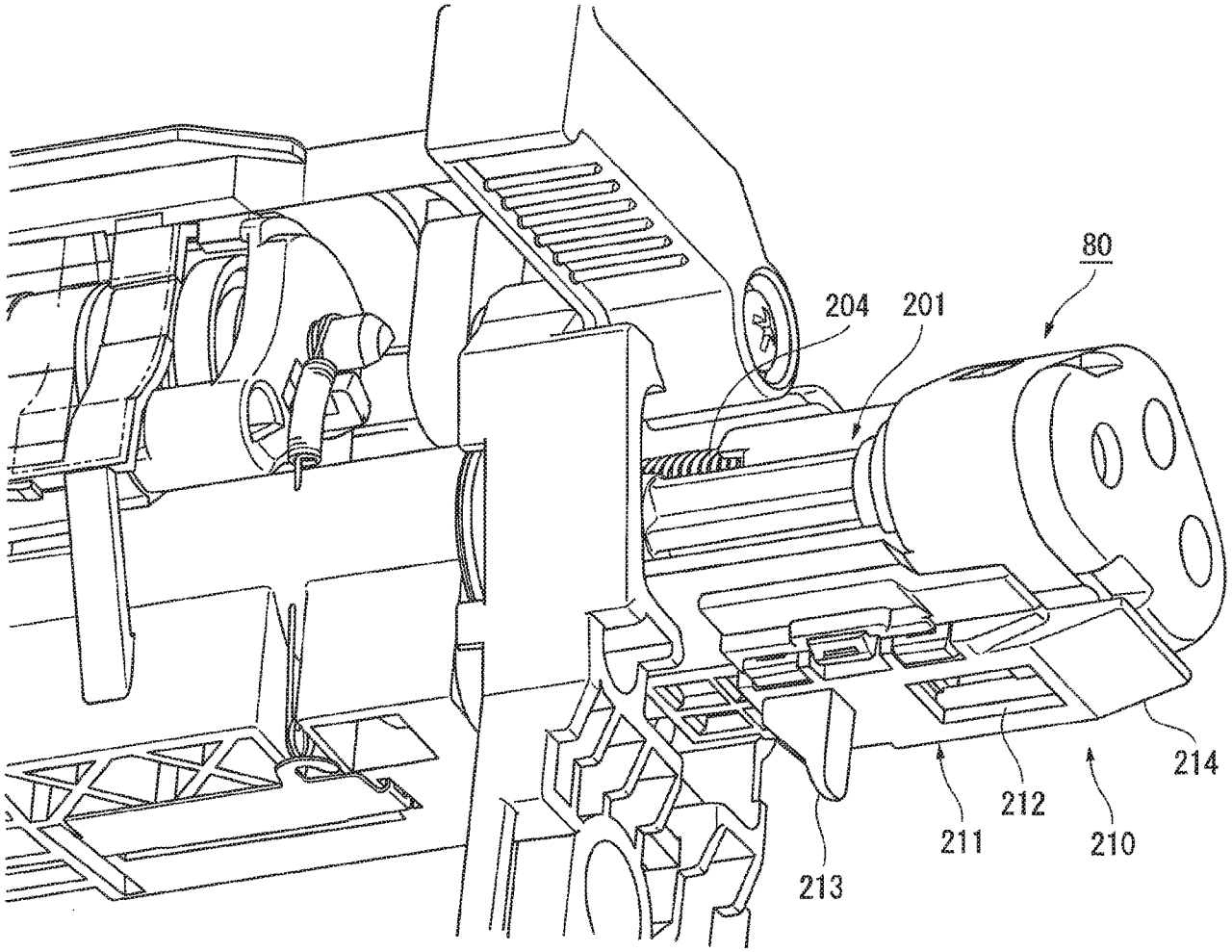
FIG. 7 is an enlarged partial view of the waste-developer discharging device of FIG. 6.
Figure 8:
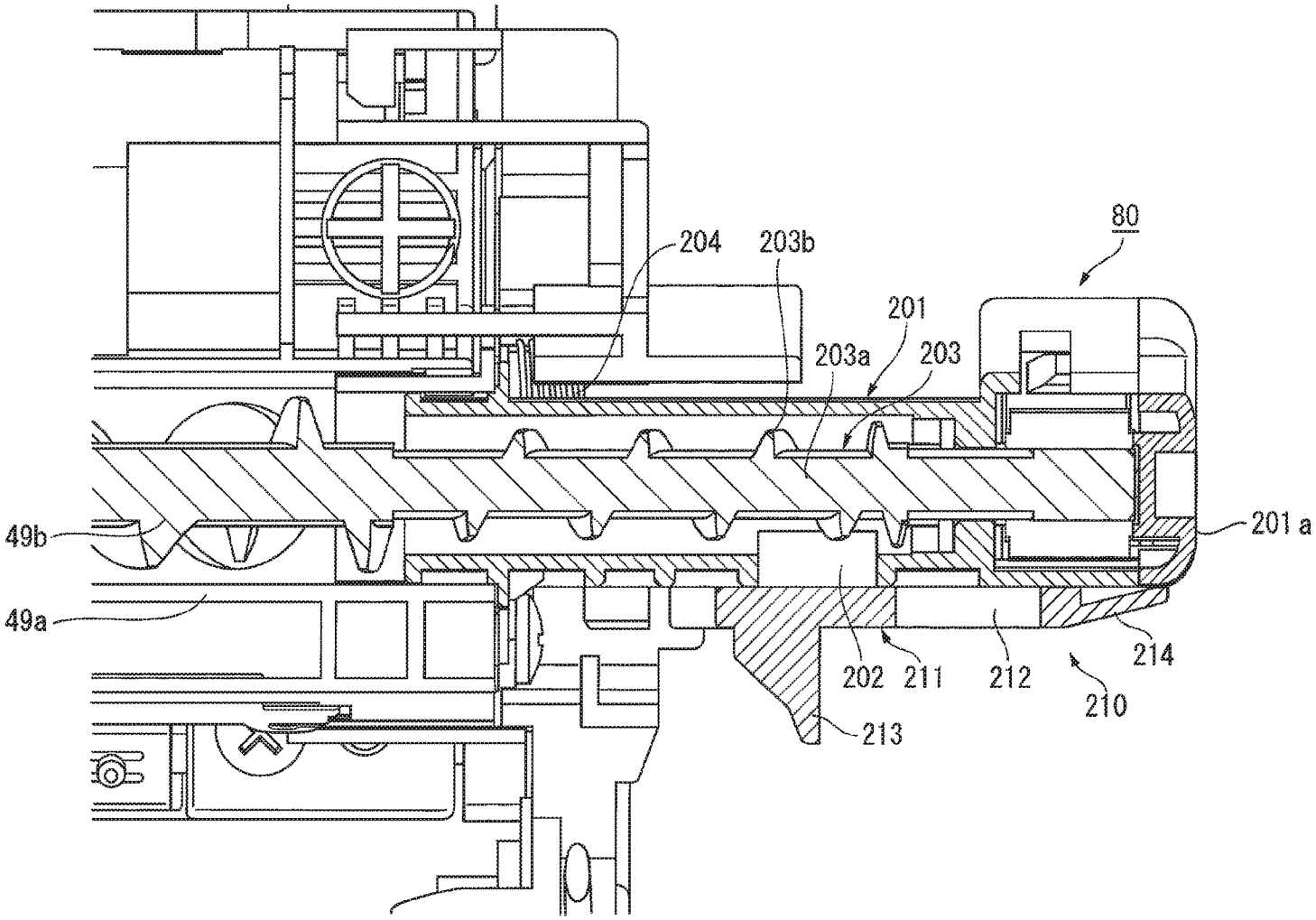
FIG. 8 is an explanatory view illustrating a cross section of the waste-developer discharging device of FIG. 7.

FIGS. 6 to 8 are perspective views of a waste-developer discharging device 80 corresponding to one element of the powder collection device of the first exemplary embodiment. FIG. 7 is an enlarged partial view of the waste-developer discharging device 80 of FIG. 6, and FIG. 8 illustrates a cross-section of the waste-developer discharging device 80 of FIG. 7. Each developing device 49 of the first exemplary embodiment includes a developing container 49*a* extending in the rotation axis direction of the corresponding photoconductor 46 (see FIG. 2). Inside the developing container 49*a*, developing elements, such as a developing roller for developing an electrostatic latent image on the photoconductor 46 and an agitating transport member for agitating and transporting developer, are provided. The waste-developer discharging device 80 (81 to 84: see, for example, FIG. 4) is provided at one longitudinal end of the developing container 49*a* to periodically discharge waste developer in the developing device 49. The waste-developer discharging device 80 communicates with and is connected to the developing container 49*a* in the longitudinal direction of the developing container 49*a*. A distal end portion of the waste-developer discharging device 80 includes a transport duct 201 (corresponding to the first transport pipe) having a substantially rectangular discharging port 202 (corresponding to the first discharging port) opening downward, and a shutter mechanism 210 (corresponding to the first pipe-side opening/closing mechanism) provided on a side of the transport duct 201 close to the discharging port 202 to open and close the discharging port 202 in the longitudinal direction of the transport duct 201.

Transport Duct

In the first exemplary embodiment, the transport duct 201 includes a transport member 203 connected coaxially and integrally with the agitating transport member 49*b* for developer (in the first exemplary embodiment, a spiral blade 203*b* is provided around a rotation axis 203*a*). Waste developer transported from the inside of the developing container 49*a* into the transport duct 201 is transported to the discharging port 202 by the transport member 203.

Shutter Mechanism

The shutter mechanism 210 of the first exemplary embodiment includes an opening/closing lid 211 (corresponding to the first opening/closing lid) which linearly moves between predetermined open and closing positions along the longitudinal direction of the transport duct 201 at the discharging port 202 provided on the lower side of the transport duct 201 close to a protruding end in the longitudinal direction. When the collection container 100 is attached to the apparatus housing 41, the discharging port 202 is opened by moving the opening/closing lid 211 in cooperation with an operating member of the collection container 100 (to be described later). The opening/closing lid 211 includes a communicating port 212 that is slightly larger than the discharging port 202 of the transport duct 201, and an arm portion 213 projecting downward at a position closer to the apparatus housing 41 (see FIG. 4) than the communicating port 212. The opening and closing lid 211 further includes a connecting piece 214 provided on a side of the opening/closing lid 211 different from the arm portion 213 and projecting in the longitudinal direction of the transport duct 201. In FIGS. 7 and 8, a bias spring 204 biases the opening/closing lid 211 toward the longitudinal protruding end of the transport duct 201. By the biasing force of the bias spring 204, a force in a direction to close the discharging port 202 of the transport duct 201 is applied to the opening/closing lid 211. In FIG. 8, a protruding end portion 201*a* of the transport duct 201 corresponds to an operating member of a container-side shutter mechanism in the collection container 100 to be described later.

Waste-Toner Discharging Device

Figure 9:
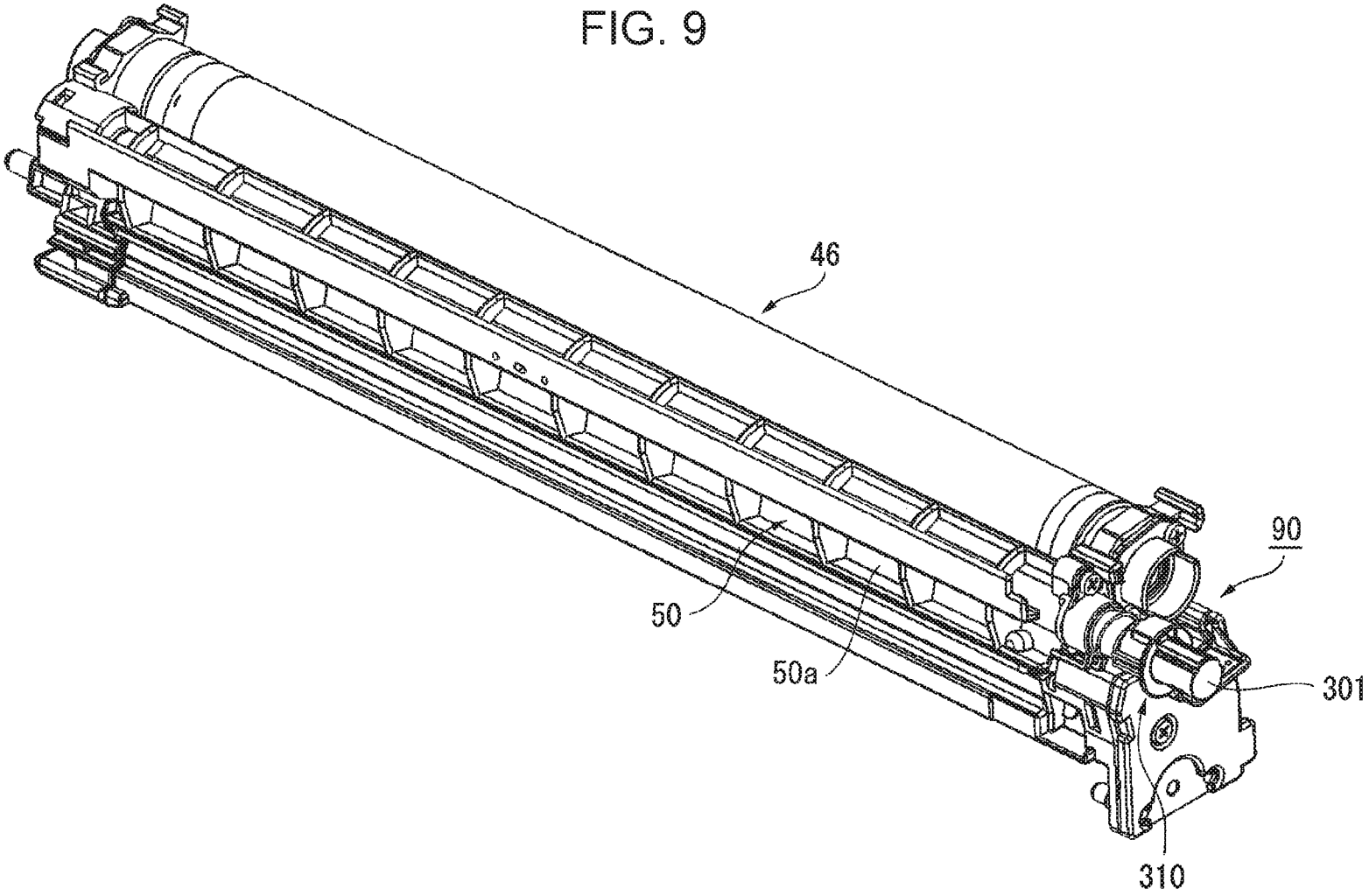
FIG. 9 is a perspective view of a waste-toner discharging device in the first exemplary embodiment.
Figure 10:
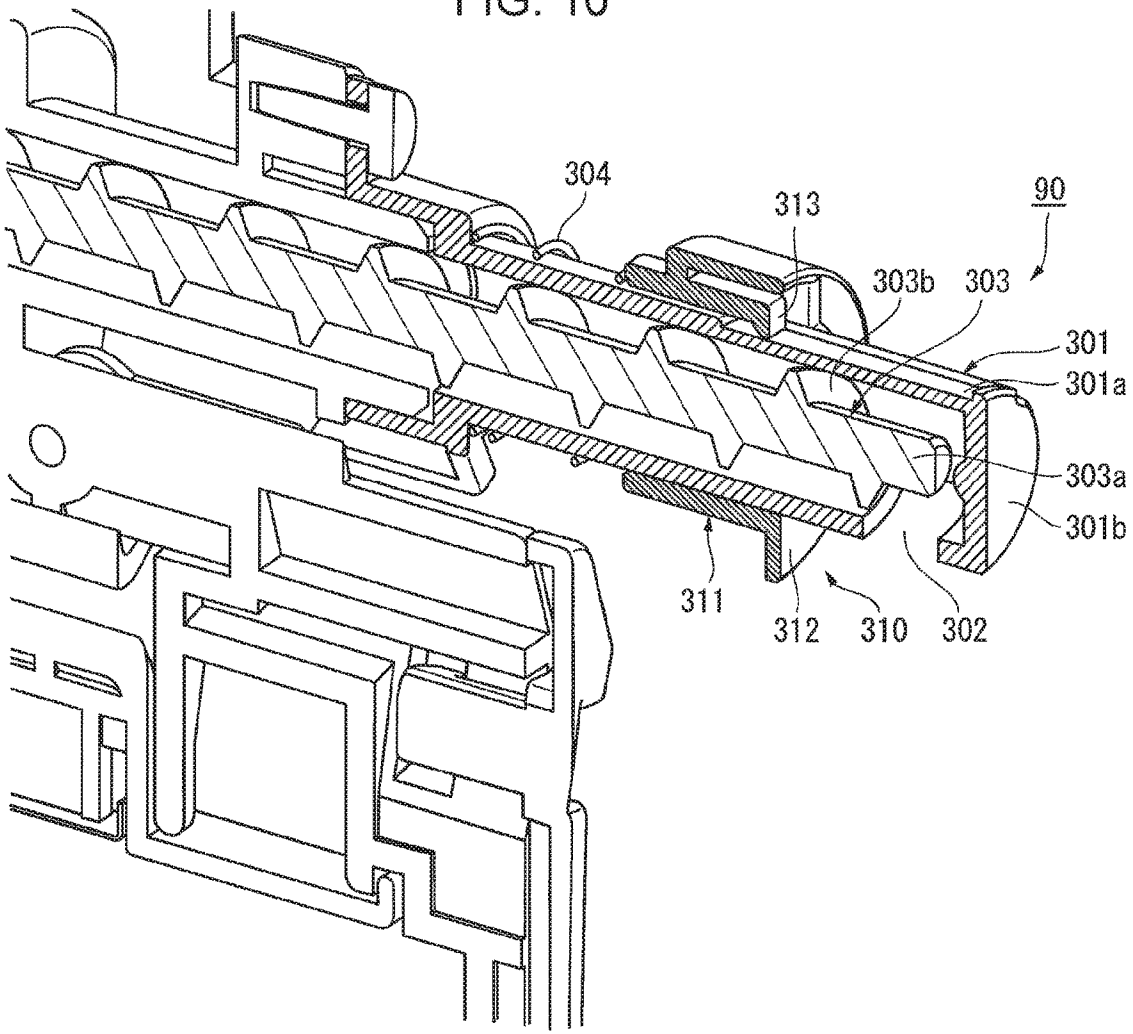
FIG. 10 is a partial sectional view of the waste-toner discharging device of FIG. 9.
Figure 11:
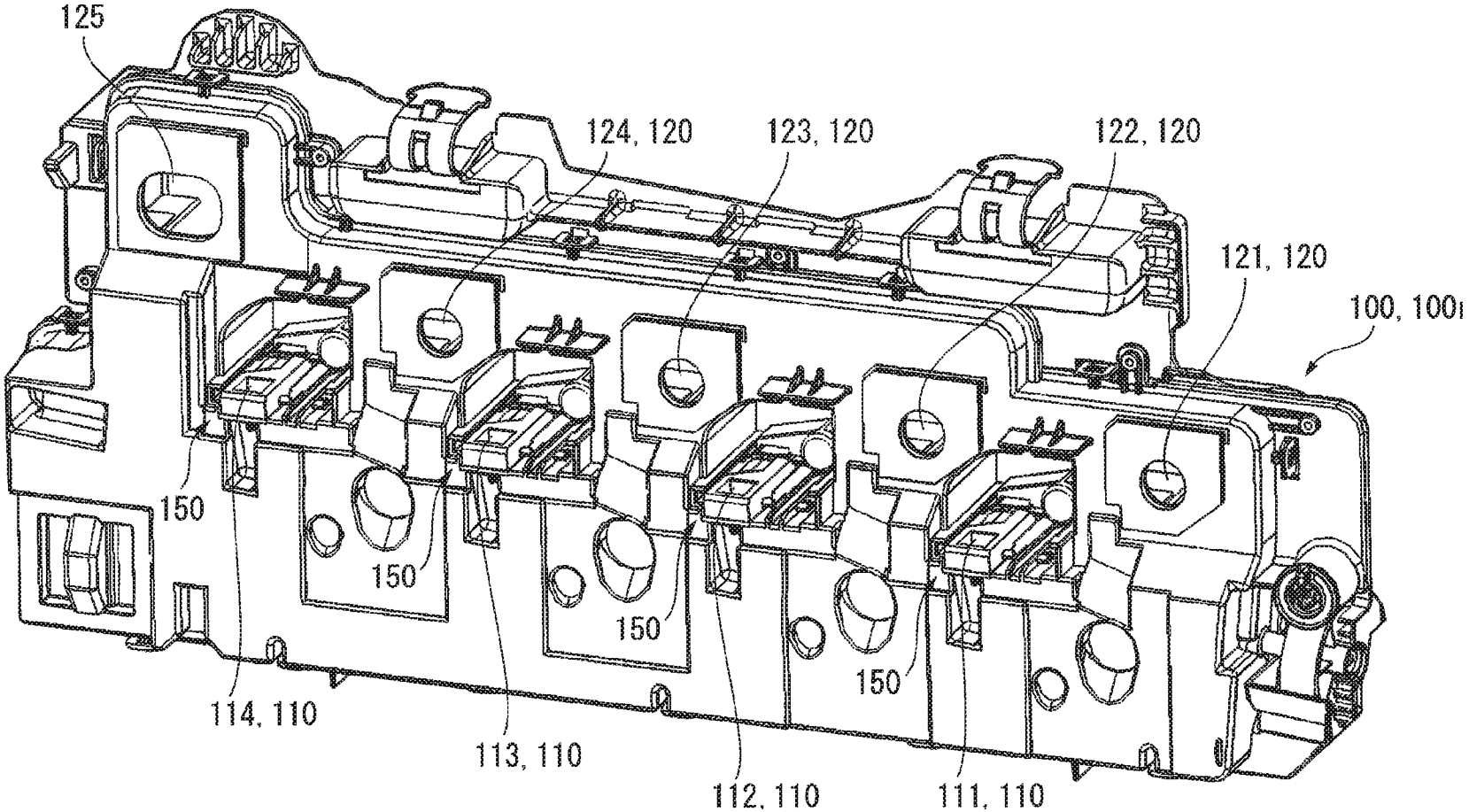
FIG. 11 is a perspective view of a collection container in the first exemplary embodiment.
Figure 12:
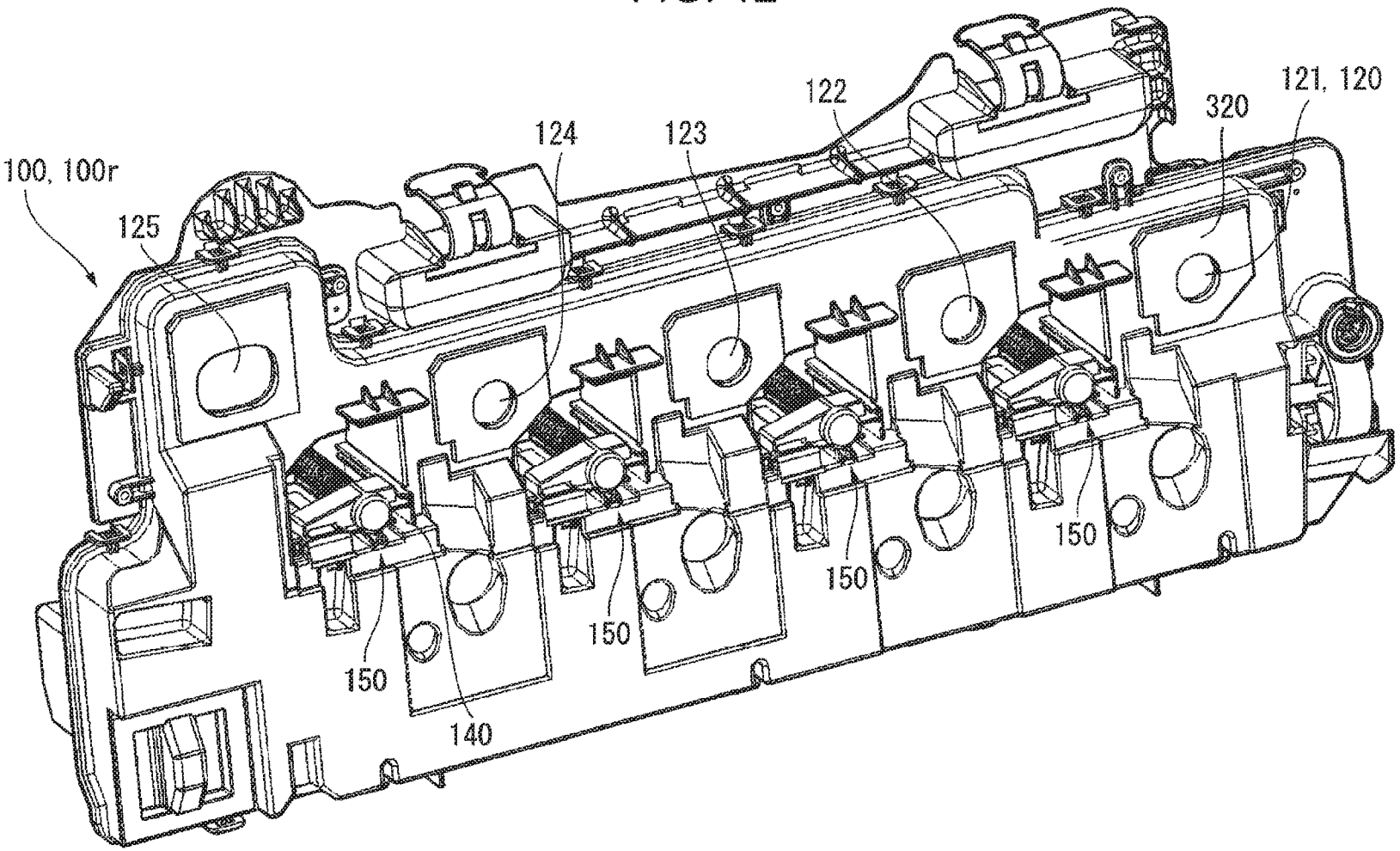
FIG. 12 is another perspective view of the powder collection container in the first exemplary embodiment.

FIGS. 9 and 10 are perspective views of a waste-toner discharging device 90 of the first exemplary embodiment, and FIG. 10 illustrates a partial cross section of the waste-toner discharging devices 90 of FIG. 9. Each cleaning device 50 of the first exemplary embodiment includes a cleaning container 50*a* extending in the rotation axis direction of the photoconductor 46. Inside the cleaning container 50*a*, a transport member (not illustrated) is provided to transport waste toner in the rotation axis direction of the photoconductor 46, and each waste-toner discharging device 90 (91 to 94: see, for example, FIG. 4) is provided at a terminal end inside the cleaning container 50*a* in the waste-toner transport direction. In the first exemplary embodiment, the waste-toner discharging device 90 communicates with and is connected to the cleaning container 50*a*. A distal end portion of the waste-toner discharging device 90 includes a transport duct 301 (corresponding to the second transport pipe) having a substantially rectangular discharging port 302 (corresponding to the second discharging port) opening downward, and a shutter mechanism 310 (corresponding to the second pipe-side opening/closing mechanism) which opens and closes the discharging port 302 of the transport duct 301.

Transport Duct

The transport duct 301 of the first exemplary embodiment has a closed distal end a substantially cylindrical cross section. Inside the transport duct 301, a transport member 303 is connected coaxially and integrally with the transport member (not illustrated) in the cleaning device 50 (a spiral blade 303*b* is provided around a rotation shaft 303*a* in the first exemplary embodiment). The transport member 303 transports waste toner transported from the inside of the cleaning container 50*a* into the transport duct 301 to the discharging port 302.

Shutter Mechanism

The shutter mechanism 310 includes an opening/closing lid 311 (corresponding to the second opening/closing lid) formed by a cylindrical member that moves between predetermined open and closing positions along an outer periphery of the transport duct 301 to open and close the discharging port 302 on the lower side of the transport duct 301 close to a protruding end in the longitudinal direction. When the collection container 100 is attached to the apparatus housing 41 (see FIG. 4), the shutter mechanism 310 opens the discharging port 302 by moving the opening/closing lid 311 in cooperation with an operating member of the collection container 100 (to be described later). For this reason, in the first exemplary embodiment, a groove 301*a* along the longitudinal direction is provided in a part of the transport duct 301, and a flange portion 312 spread in a flange shape is provided at a distal end of the opening/closing lid 311 (at the protruding end of the transport duct 301). Moreover, a claw portion 313 that moves while slipping in the groove 301*a* of the transport duct 301 is provided to form a constant moving track of the opening/closing lid 311 relative to the transport duct 301. Around the transport duct 301, a bias spring 304 is provided to bias the opening/closing lid 311 toward the protruding end of the transport duct 301, and biases the opening/closing lid 311 toward the protruding end of the transport duct 301 so that the discharging port 302 is closed by the opening/closing lid 311. In this structure, after the opening/closing lid 311 is mounted from the distal end of the transport duct 301, the claw portion 313 moves along the groove 301*a*, so that the opening/closing lid 311 opens and closes the discharging port 302 while its rotation is prevented. FIG. 10 illustrates a state in which the opening/closing lid 311 is at the open position and the discharging port 302 is opened.

While the waste-toner discharging device 95 is further provided for the belt cleaning device 54 in the first exemplary embodiment, it has a structure substantially similar to that of the waste-toner discharging device 90 for the cleaning device 50. Hence, a description of the waste-toner discharging device 95 is skipped here.

Collection Container

In the first exemplary embodiment, waste developer and waste toner discharged from the waste-developer discharging devices 80, the waste-toner discharging devices 90, and the waste-toner discharging device 95 are collected in the collection container 100. The collection container 100 of the first exemplary embodiment is assembled to the apparatus housing 41 (corresponding to the apparatus body) while opening a front covering 41*a* of the apparatus housing 41, for example, as illustrated in FIG. 4, and collects used developer (waste developer and waste toner).

Figure 13:
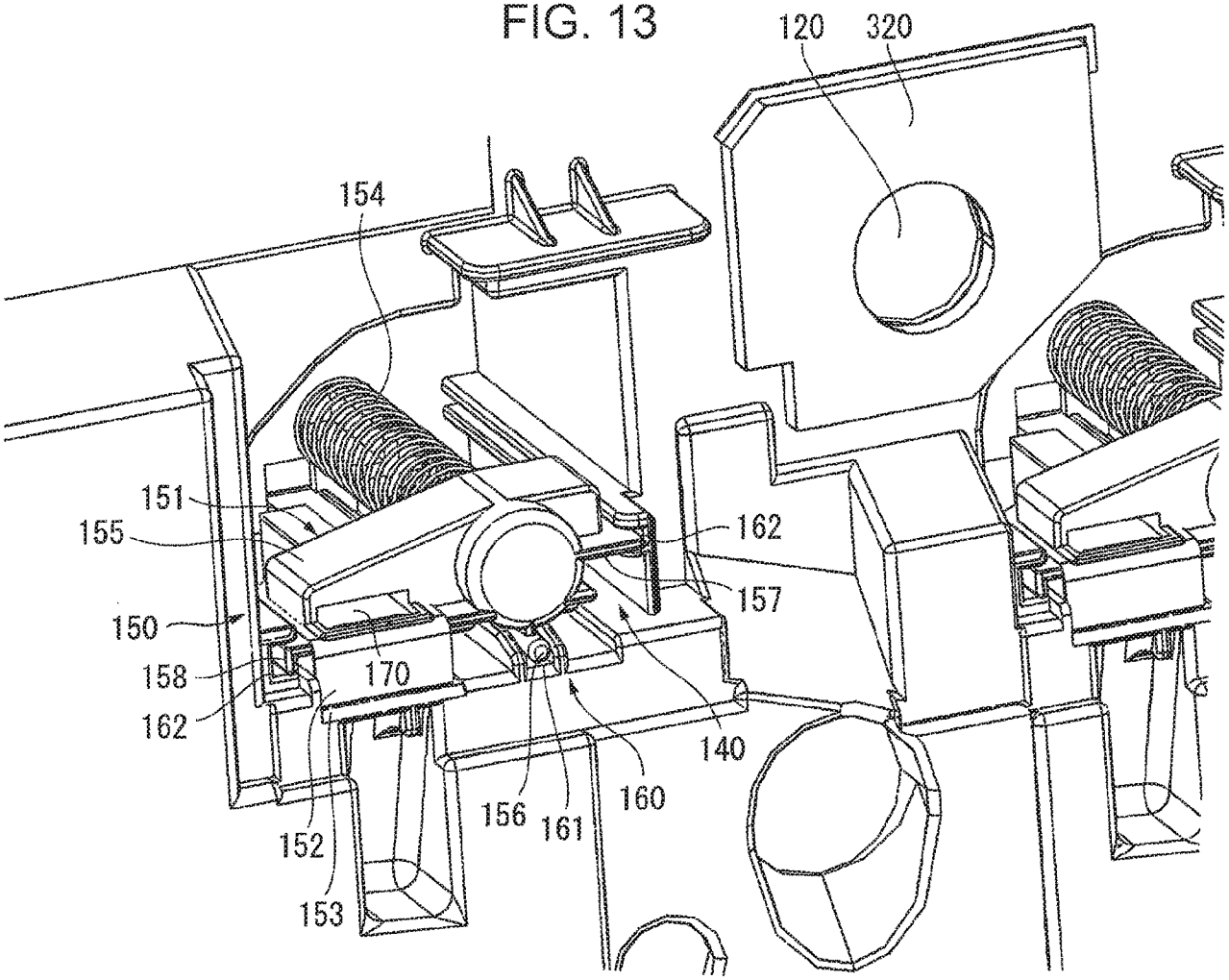
FIG. 13 is a perspective view of a shutter mechanism provided in the collection container.
Figure 14:
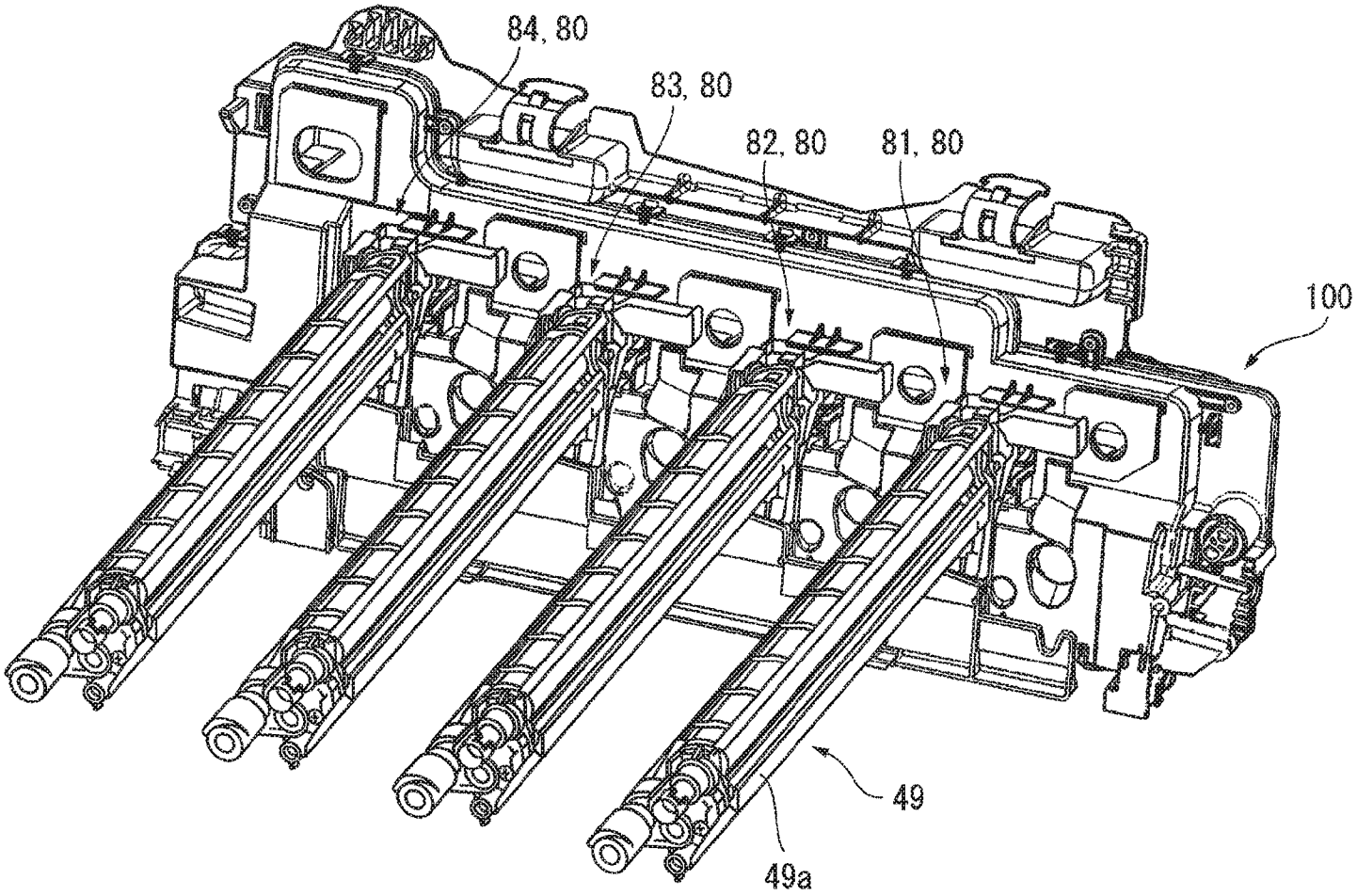
FIG. 14 is an explanatory view illustrating the relationship between developing devices and the collection container when the collection container is attached.

FIGS. 11 to 14 are perspective views of the collection container 100. FIG. 13 illustrates a container shutter mechanism 150 provided in the collection container 100 to be described later, and FIG. 14 is an explanatory view illustrating the positional relationship between developing devices 49 and the collection container 100 after the collection container 100 is attached. As the collection container 100 of the first exemplary embodiment, the front case 100*f* and the rear case 100*r* are combined into one unit as a container body, and a storage space (corresponding to the powder receiving chamber) for developer (waste developer and waste toner) as powder is ensured inside the container body.

In the first exemplary embodiment, the rear case 100*r* has collection ports 110 (111 to 114: corresponding to the first collection port) to which the waste-developer discharging devices 80 (81 to 84) are to be connected, collection ports 120 (121 to 124: corresponding to the second collection port) to which the waste-toner discharging devices 90 (91 to 94) are to be connected, and a collection port 125 to which the waste-toner discharging device 95 is to be connected when the collection container 100 is attached to the apparatus housing 41. The collection ports 110, the collection ports 120, and the collection port 125 are provided at the positions corresponding to the devices. In the first exemplary embodiment, the collection ports 110 and the collection ports 120 are arranged in the up-down direction (collection ports 120 are disposed on the upper side), and are each disposed in a state slightly inclined with respect to the substantially horizontal direction at four positions. The collection port 125 is located on an oblique upper side of the collection ports 120.

Container Shutter Mechanism for Waste-Developer Discharging Device

On a side of the collection container 100 provided with the collection ports 110, container shutter mechanisms 150 (corresponding to the first container-side opening/closing mechanism) are provided to open and close the corresponding collection ports 110 when the collection container 100 is detached from the apparatus housing 41. The collection container 100 of the first exemplary embodiment has recesses 140 (corresponding to the receiving portion) in which the distal ends of the waste-developer discharging devices 80 (81 to 84) (distal ends of the transport ducts 201) are to be inserted when the collection container 100 is attached to the apparatus housing 41. The collection ports 110 (111 to 114) are provided at the bottoms of the recesses 140, and the container shutter mechanisms 150 are set around the corresponding collection ports 110.

Each container shutter mechanism 150 of the first exemplary embodiments has a container opening/closing lid 151 (corresponding to the first container opening/closing lid) which linearly moves in the corresponding recess 140 of the collection container 100 from the rear case 100*r* side toward the front case 100*f* side. When the collection container 100 is attached to the apparatus housing 41, the container shutter mechanism 150 opens the corresponding collection port 110 by moving the container opening/closing lid 151 at the collection port 110 in cooperation with an operating member provided in the transport duct 201, that is, the protruding end portion 201*a* of the transport duct 201 (see FIG. 8) in the first exemplary embodiment. The collection port 110 to be opened and closed by the container opening/closing lid 151 in the first exemplary embodiment is formed by fixing a seal member 152 having a hole corresponding to the collection port 110 to an elastic member made of, for example, urethane rubber. When the container opening/closing lid 151 is located at a closing position to close the collection port 110, a gap between the collection port 110 and the container opening/closing lid 151 is sealed with the seal member 152. Further, a bias spring 154 is provided on the depth side of the recess 140. This bias spring 154 applies a biasing force in a direction to close the collection port 110 to the container opening/closing lid 151. A holding member 153 holds the seal member 152, and serves as an operating member for moving the opening/closing lid 211 of the transport duct 201.

The container opening/closing lid 151 of the first exemplary embodiment further has a member body 155 extending in the width direction intersecting the opening/closing direction of the container opening/closing lid 151 inside the recess 140. A guided rod 156 extending along the opening/closing direction of the container opening/closing lid 151 is provided integrally with the bottom of the member body 155, and guided portions 157 and 158 protrude from opposite widthwise ends of the member body 155. On the other hand, a guide mechanism 160 is provided in the recess 140 of the first exemplary embodiment to guide the container opening/closing lid 151 along the opening/closing direction. The guide mechanism 160 includes a guide groove 161 that guides the guided rod 156 of the container opening/closing lid 151 and guide portions 162 that guide the guided portions 157 and 158. In the first exemplary embodiment, a gap 170 is provided along the opening/closing direction of the container opening/closing lid 151 between the member body 155 of the container opening/closing lid 151 and the seal member 152. The connecting piece 214 (see FIG. 8) of the opening/closing lid 211 in the waste-developer discharging device 80 is connected into the gap 170.

Container Shutter Mechanism for Waste-Toner Discharging Device

A shutter mechanism for each waste-toner discharging device 90 has a container opening/closing lid (not illustrated) which opens and closes the collection port 120 (corresponding to the second collection port) provided in a predetermined receiving portion of the collection container 100 above the container shutter mechanism 150 (corresponding to the first container-side opening/closing mechanism) for the waste-developer discharging device 80. When the collection container 100 is attached to the apparatus housing 41, the shutter mechanism opens the collection port 120 by moving the container opening/closing lid (not illustrated) at the collection port 120 in cooperation with an operating member provided in the transport duct 301 (a protruding end portion 301*b* of the transport duct 301: see FIG. 10). In the first exemplary embodiment, a seal member 320 is fixed around the collection port 120. The seal member 320 is formed by an elastic member having an outer size larger than the collection port 120 and having a hole of almost the same size as the collection port 120. The seal member 320 of the first exemplary embodiment is formed of, for example, urethane rubber. When the collection container 100 is attached to the apparatus housing 41, the seal member 320 comes into contact with the flange portion 312 (see FIG. 10) of the opening/closing lid 311 in the waste-toner discharging device 90 to improve sealing performance between the collection container 100 and the apparatus housing 41. The container opening/closing lid for the collection port 120 is structured, for example, so that a member formed of an elastic film material is attached to an inner side of the collection port 120 to turn on an upper edge portion as a pivot, and is biased to close the collection port 120 by a bias spring provided at the pivot. Thus, in a state in which the collection container 100 is provided alone, the container opening/closing lid closes the collection port 120. In the first exemplary embodiment, the collection port 120 corresponds to the receiving portion in the collection container 100.

Regarding Position of Pivot Center

Waste-Developer Discharging Device Side

Figure 15:
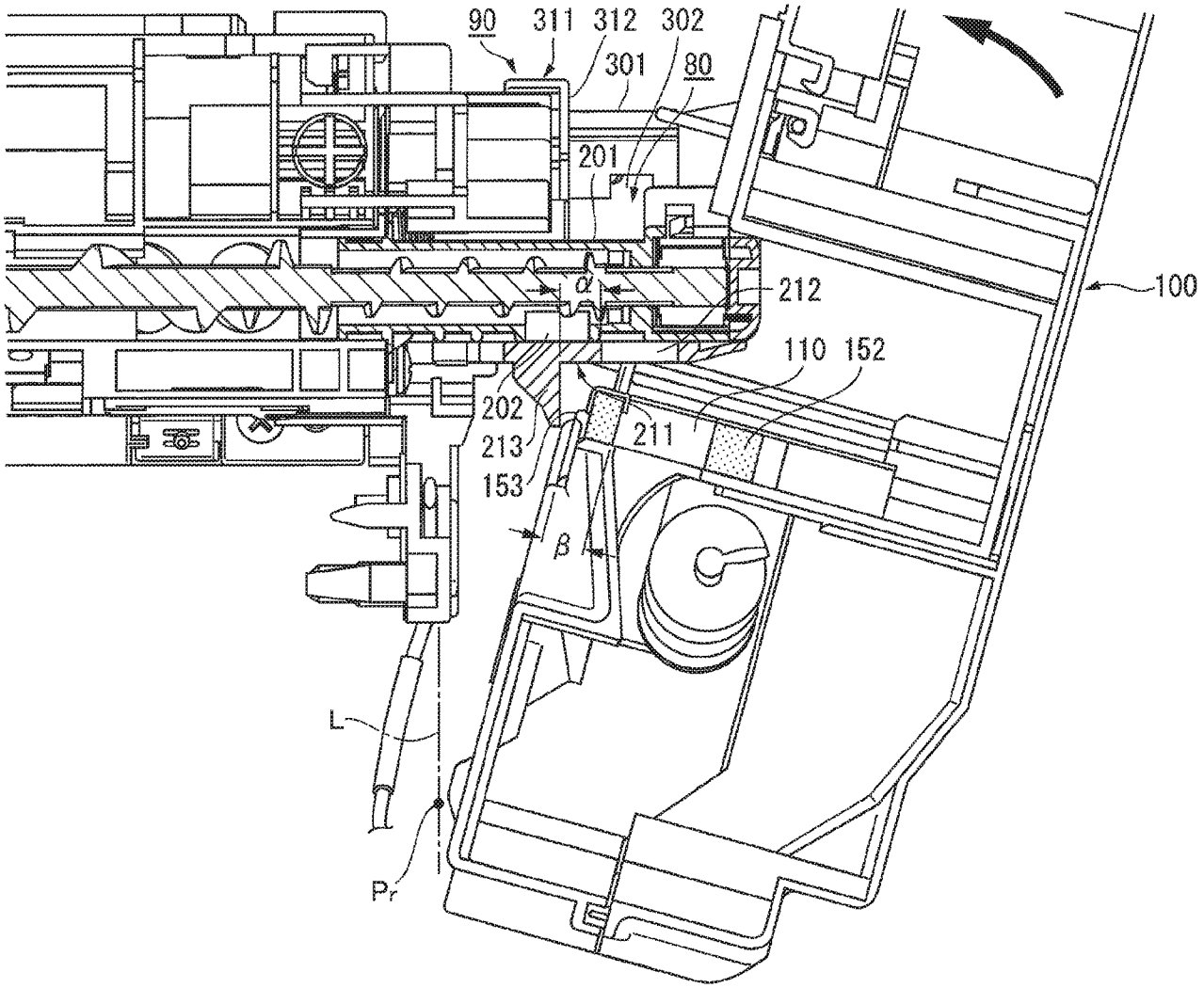
FIG. 15 is an explanatory view illustrating the relationship between the waste-developer discharging device and the collection container before the collection container is attached to an apparatus housing.
Figure 16:
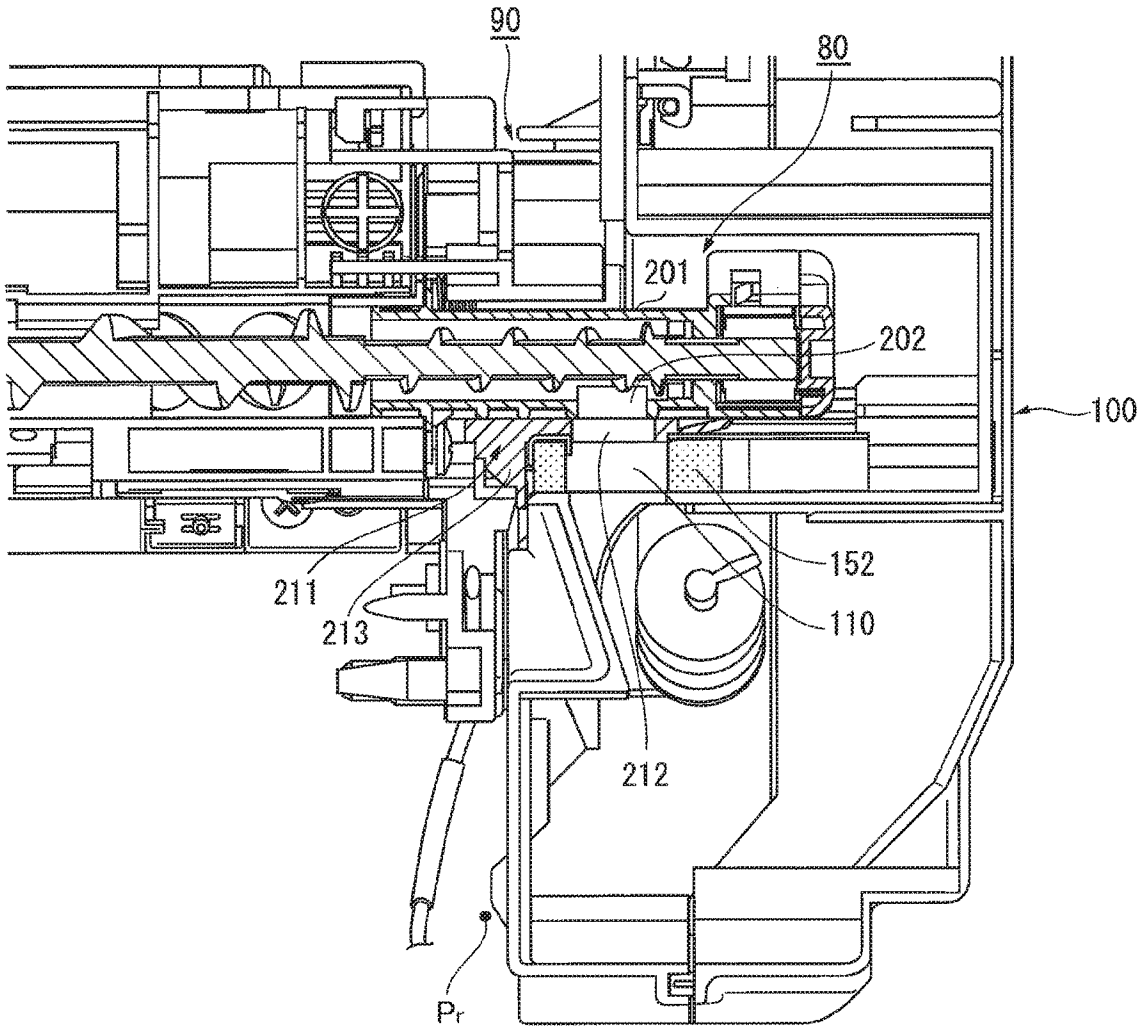
FIG. 16 is an explanatory view illustrating the relationship between the waste-developer discharging device and the collection container after the collection container is attached to the apparatus housing.

FIGS. 15 and 16 illustrate the relationship between the collection container 100 and the position of the pivot center Pr of the collection container 100 in the waste-developer discharging device. FIG. 15 illustrates a state before the collection container 100 is attached to the apparatus housing 41 (not illustrated), and FIG. 16 illustrates a state after the collection container 100 is attached to the apparatus housing 41. That is, the collection container 100 is attached to the attachment part of the apparatus housing 41 by being turned on the pivot center Pr.

In the first exemplary embodiment, the pivot center Pr is provided at a position such that the discharging port 202 of the waste-developer discharging device 80 is disposed on the side of the vertical line L including the pivot center Pr different from the apparatus housing 41. The position of the pivot center Pr along the vertical line L is such that the seal member 152 of the collection container 100 is elastically deformed by the opening/closing lid 211 when the discharging port 202 of the waste-developer discharging device 80 is opened. At an exemplary position illustrated in FIGS. 15 and 16, the discharging port 302 of the waste-toner discharging device 90 is located on a side of the discharging port 202 of the waste-developer discharging device 80 different from the apparatus housing 41.

Waste-Toner Discharging Device Side

Figure 17:
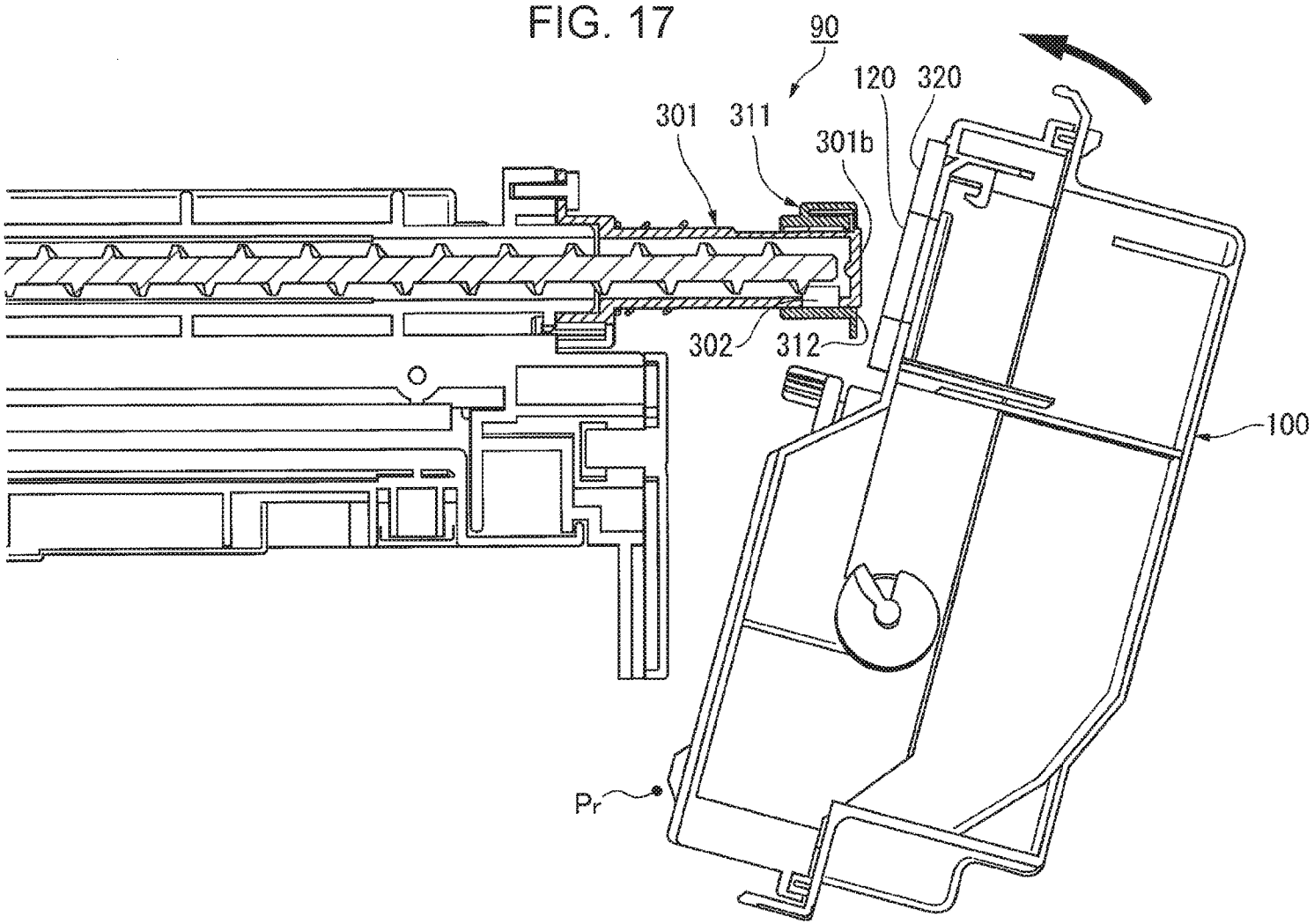
FIG. 17 is an explanatory view illustrating the relationship between the waste-toner discharging device and the collection container before the collection container is attached to the apparatus housing.
Figure 18:
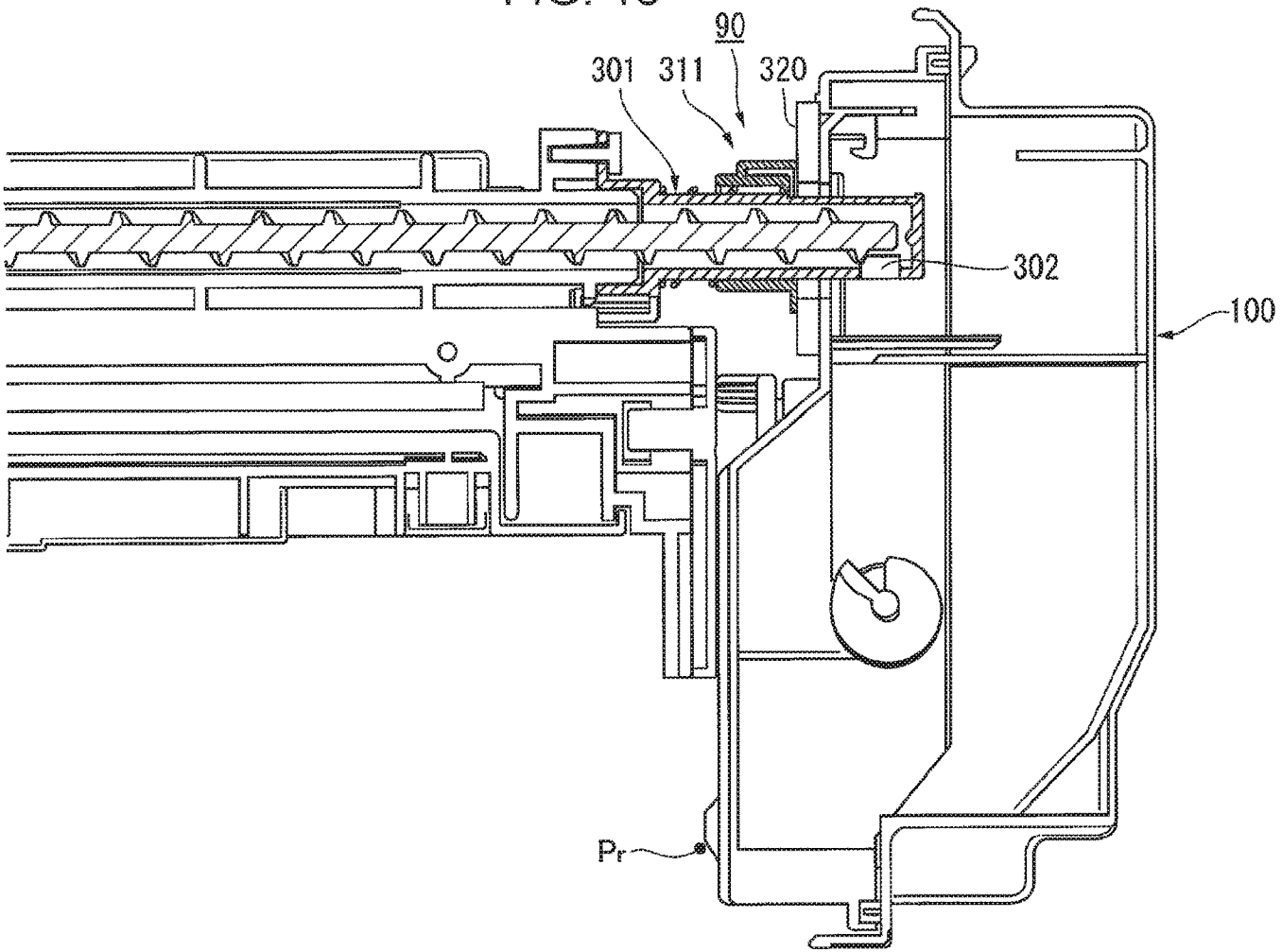
FIG. 18 is an explanatory view illustrating the relationship between the waste-toner discharging device and the collection container after the collection container is attached to the apparatus housing.

FIGS. 17 and 18 illustrate the relationship between the collection container 100 and the position of the pivot center Pr of the collection container 100 in the waste-toner discharging device. FIG. 17 illustrates a state before the collection container 100 is attached to the apparatus housing 41 (not illustrated), and FIG. 18 illustrates a state after the collection container 100 is attached to the apparatus housing 41. In FIGS. 17 and 18, the discharging port 302 of the waste-toner discharging device 90 of the first exemplary embodiment is disposed on the side of the pivot center Pr different from the apparatus housing 41. As illustrated in FIG. 15, in the first exemplary embodiment, the discharging port 302 of the waste-toner discharging device 90 is located on the side of the discharging port 202 of the waste-developer discharging device 80 different from the apparatus housing 41.

Operation of Pivot Center

Before explaining a specific operation of the first exemplary embodiment, the operation of the pivot center and the waste-developer discharging device will be first schematically described with a comparative example.

Figure 19B:
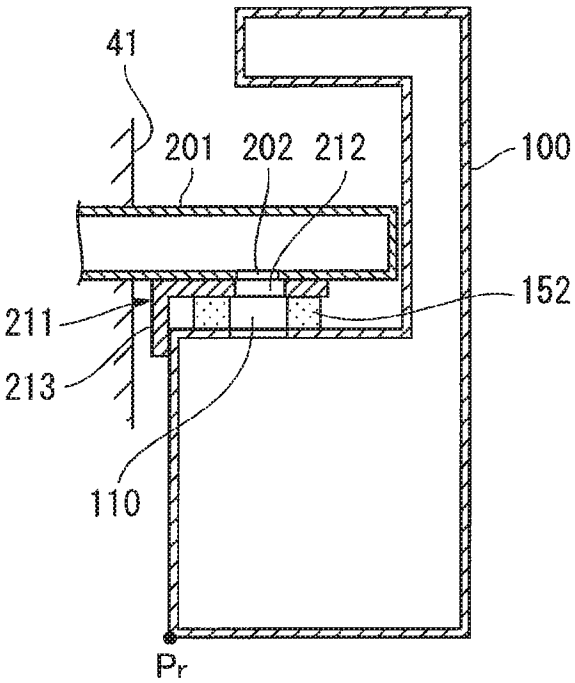
FIGS. 19A and 19B are schematic views illustrating the relationship between the waste-developer discharging device and the collection container before and after the collection container is attached in the structure of the first exemplary embodiment.
Figure 19A:
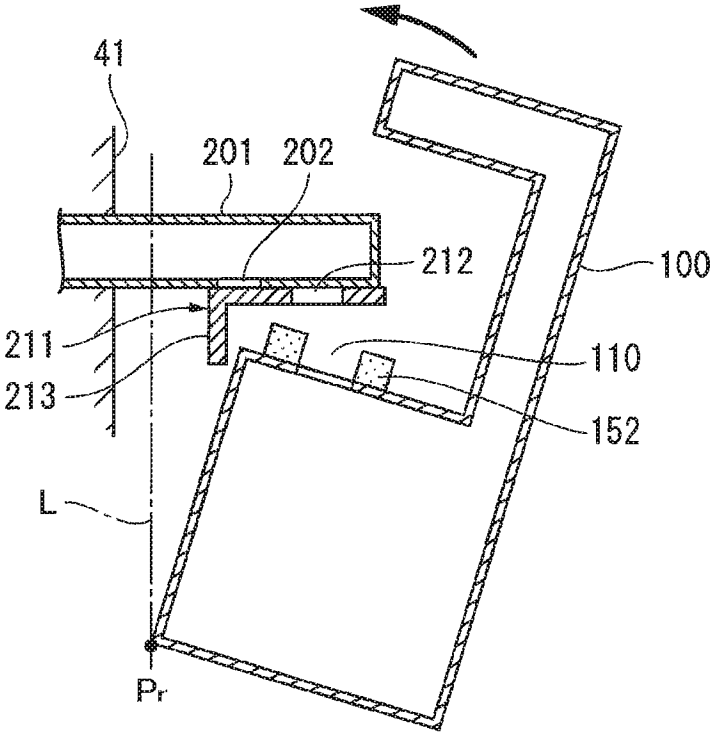

FIGS. 19A and 19B schematically illustrate the operation of a structure similar to that of the first exemplary embodiment. FIG. 19A illustrates a state before attachment, and FIG. 19B illustrates a state after attachment. Referring to FIGS. 19A and 19B, in a case in which the discharging port 202 is located on the side of the vertical line L including the pivot center Pr different from the apparatus housing 41, when the collection container 100 is turned, the operating member of the collection container 100 (corresponding to the holding member 153 illustrated in FIG. 13 in the first exemplary embodiment) comes into contact with the arm portion 213 of the opening/closing lid 211, and starts to move the opening/closing lid 211. At this time, since the distal end of the seal member 152 does not touch the opening/closing lid 211, deformation of the seal member 152 is suppressed, and the opening/closing lid 211 is stably opened. When the collection container 100 is further turned, the opening/closing lid 211 moves toward the apparatus housing 41, the distal end of the seal member 152 starts contact with the opening/closing lid 211, and the seal member 152 deforms. When the collection container 100 is further turned, the communicating port 212 of the opening/closing lid 211 is located at the discharging port 202, and the turn of the collection container 100 is finished. At this time, the discharging port 202, the communicating port 212, and the collection port 110 are aligned, and this allows waste developer from the discharging port 202 to be stably collected in the collection container 100. In such a case in which the discharging port 202 is located on the side of the vertical line L including the pivot center Pr different from the apparatus housing 41, deformation of the seal member 152 becomes the largest at the time when the collection container 100 stops. Deformation of the seal member 152 does not become the largest until the discharging port 202 and the communicating port 212 are aligned.

Figure 20B:
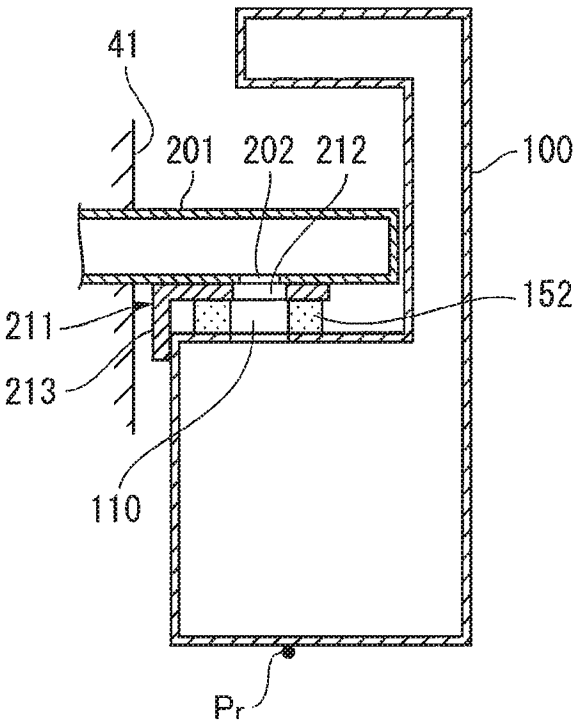
FIGS. 20A and 20B are schematic views illustrating the relationship between a waste-developer discharging device and a collection container before and after the collection container is attached in a structure of a comparative exemplary embodiment.
Figure 20A:
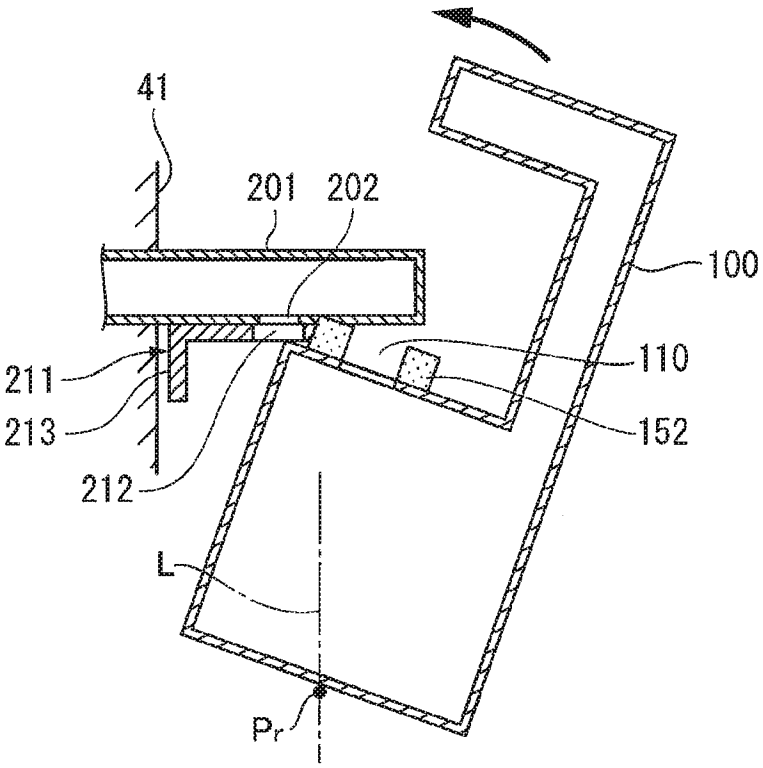

In contrast, FIGS. 20A and 20B schematically illustrate the operation of a structure of a comparative example in which the discharging port 202 is located on the same side of the vertical line L including the pivot center Pr as the apparatus housing 41 (not illustrated). FIG. 20A illustrates a state before attachment, and FIG. 20B illustrates a state after attachment. In FIGS. 20A and 20B, the distance from the transport duct 201 to the pivot center Pr is the same as that in FIGS. 19A and 19B.

Referring to FIGS. 20A and 20B, in a case in which the discharging port 202 is located on the same side of the vertical line L including the pivot center Pr as the apparatus housing 41, when the collection container 100 turns, the seal member 152 comes into contact with the opening/closing lid 211, and increases its deformation. For this reason, the opening/closing lid 211 moves earlier, the discharging port 202 and the communicating port 212 are connected earlier, and waste developer leaks to a portion other than the collection container 100. Alternatively, since deformation of the seal member 152 becomes the largest before the collection container 100 finishes turning, the shape of the seal member 152 itself is apt to be unstable, and a gap may be formed between the opening/closing lid 211 and the seal member 152. This may cause scattering of waste developer. Therefore, it has an effect where to set the pivot center Pr.

Next, the pivot center Pr of the first exemplary embodiment will be described in more detail with reference to FIGS. 15 to 18.

Waste-Developer Discharging Device Side

Referring to FIGS. 15 and 16, when the collection container 100 is turned on the position of the pivot center Pr, the distal end of the holding member 153 that holds the seal member 152 in the collection container 100 first comes into contact with the arm portion 213 of the opening/closing lid 211 in the waste-developer discharging device 80, and pushes the arm portion 213 toward the apparatus housing 41 (not illustrated). After that, when the distal end of the seal member 152 comes into contact with the opening/closing lid 211, the seal member 152 elastically deforms and adhesion between the opening/closing lid 211 and the seal member 152 is increased. Finally, as illustrated in FIG. 16, the opening/closing lid 211 moves, the discharging port 202 of the waste-developer discharging device 80 and the collection port 110 of the collection container 100 communicate with each other with the communicating port 212 of the opening/closing lid 211 being disposed therebetween, and waste developer is collected into the collection container 100.

In the first exemplary embodiment, in particular, a length $\alpha$ from the arm portion 213 to the communicating port 212 in the opening/closing lid 211 is slightly longer than a length $\beta$ from the distal end of the holding member 153 to the collection port 110 in the collection container 100. Hence, when the communicating port 212 of the opening/closing lid 211 reaches the position of the discharging port 202, the collection port 110 of the collection container 100 is located under the communicating port 212, and waste developer is easily collected into the collection container 100. In the first exemplary embodiment, since the collection port 110 is larger than the communicating port 212, the waste developer more smoothly flows from the discharging port 202 of the waste-developer discharging device 80 to the collection port 110 of the collection container 100.

Waste-Toner Discharging Device Side

Referring to FIGS. 17 and 18, when the collection container 100 is turned on the position of the pivot center Pr, the seal member 320 in the collection container 100 first comes into contact with the flange portion 312 of the opening/closing lid 311 in the waste-toner discharging device 90, and gradually pushes in the opening/closing lid 311. After that, the transport duct 301 enters the collection port 120 of the collection container 100 from the protruding end portion 301*b*, and the opening/closing lid 311 is gradually pushed toward the apparatus housing 41 (not illustrated). From the time when the seal member 320 of the collection container 100 reaches a distal end of the discharging port 302, the opening/closing lid 311 gradually opens the discharging port 302, and waste toner from the discharging port 302 is collected into the collection container 100. Although a container opening/closing lid of the collection container 100 is not illustrated in FIGS. 17 and 18, for example, when the container opening/closing lid of FIG. 2 is provided, the protruding end portion 301*b* of the transport duct 301 serves as the operating member that opens the container opening/closing lid.

In such a method in which the discharging port 302 is opened by pushing the flange portion 312 of the opening/closing lid 311 by the operating member of the collection container 100 (corresponding to the seal member 320 in the first exemplary embodiment) while turning the collection container 100, it is necessary to set the size of the collection port 120 to be larger than the size (outer size) of the protruding end portion 301*b* of the transport duct 301. When the distance between the pivot center Pr and the protruding end portion 301*b* of the transport duct 301 in the longitudinal direction of the transport duct 301 is long, the size of the collection port 120 needs to be further increased. As a result, the size of the flange portion 312 also needs to be increased. In such a structure, waste toner may be apt to leak from the discharging port 302 during attachment and detachment of the collection container 100. However, since the discharging port 302 is provided near the protruding end portion 301*b* of the transport duct 301 in the waste-toner discharging device 90, the distance between the pivot center Pr and the protruding end portion 301*b* of the transport duct 301 in the longitudinal direction of the transport duct 301 is shortened and scattering of waste toner is suppressed. While the discharging port 302 of the waste-toner discharging device 90 is provided at the position different from the discharging port 202 of the waste-developer discharging device 80 in the longitudinal direction of the transport duct 301 in the first exemplary embodiment (see FIG. 16), this does not have any influence on the waste-developer discharging device 80 even if waste toner from the waste-toner discharging device 90 scatters.

While the shutter mechanism 310 of the waste-toner discharging device 90 is provided on the upper side and the shutter mechanism 210 of the waste-developer discharging device 80 is provided on the lower side in the first exemplary embodiment, for example, when the shutter mechanism 310 of the waste-toner discharging device 90 is provided on the lower side and the shutter mechanism 210 of the waste-developer discharging device 80 is provided above the shutter mechanism 310, the distance from the pivot center Pr is too long in the upper shutter mechanism 210. Therefore, it may be necessary to increase the moving amount of the opening/closing lid 211 and to cause considerably great elastic deformation of the seal member 152. This makes it difficult to ensure a stable structure of the shutter mechanism.

While the opening/closing lid 211 of the waste-developer discharging device 80 has the communicating port 212 in the first exemplary embodiment, the seal member 152 may directly touch the shutter mechanism 210 without using the communicating port 212. Further, while the waste-developer discharging device 80 and the waste-toner discharging device 90 are provided in the first exemplary embodiment, only the waste-developer discharging device 80 may be provided.

Second Exemplary Embodiment

Figure 21:
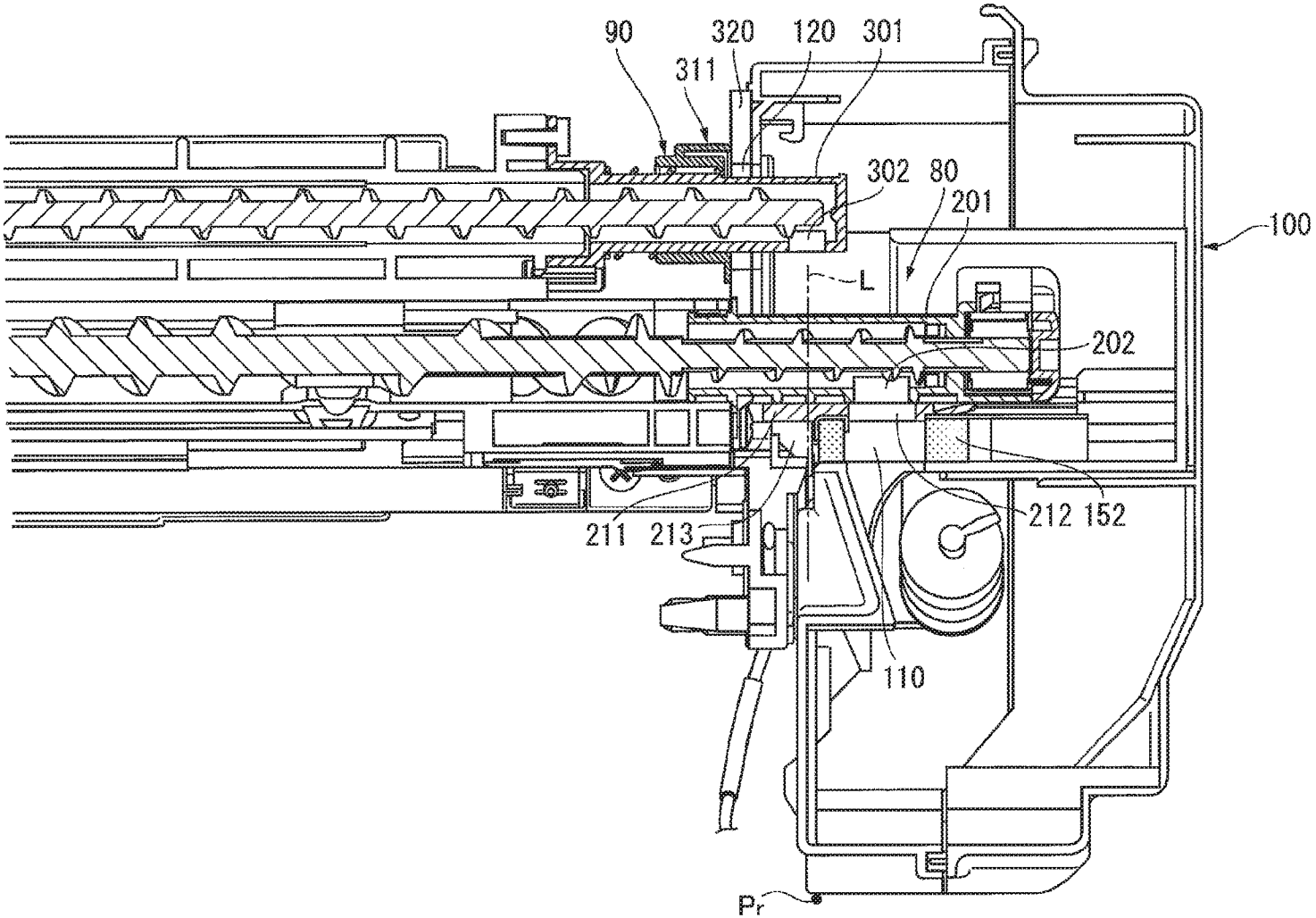
FIG. 21 is an explanatory view illustrating a state in which a collection container is attached to an apparatus housing according to a second exemplary embodiment.

FIG. 21 is an explanatory view illustrating a state in which a collection container 100 is attached to an apparatus housing 41 (not illustrated) according to a second exemplary embodiment. Referring to FIG. 21, the second exemplary embodiment is different from the first exemplary embodiment in that a discharging port 202 of a waste-developer discharging device 80 is disposed on a side of a vertical line L including a pivot center Pr different from the apparatus housing 41 and in that a discharging port 302 of a waste-toner discharging device 90 is disposed on the vertical line L. Components similar to those of the first exemplary embodiment are denoted by similar reference numerals, and detailed descriptions thereof are skipped here.

In the second exemplary embodiment, when a collection port 120 of the collection container 100 is attached to a transport duct 301 of the waste-toner discharging device 90, the motion of the collection port 120 of the collection container 100 in the longitudinal direction of the transport duct 301 is made closer to a parallel motion than when the discharging port 302 is not provided on the vertical line L. Hence, the size of the collection port 120 is made closer to the size of the transport duct 301.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder collection device comprising:

a transport pipe that transports collected powder produced in an apparatus body, wherein the apparatus body includes a powder processing unit and a cover that is pivotally fixed to the apparatus body;

a powder collection container having, therein, a powder receiving chamber that receives the collected powder, supported turnably on a pivot center provided in a lower edge portion of an attachment part of the apparatus body, and removably attached to a position to cover the attachment part of the apparatus body;

a pipe-side opening/closing mechanism having an opening/closing lid that linearly moves to open and close a discharging port provided on a bottom side of the transport pipe near a protruding end in a longitudinal direction along the longitudinal direction of the transport pipe, the pipe-side opening/closing mechanism opening the discharging port by moving the opening/closing lid at the discharging port in cooperation with an operating member provided in the powder collection container when the powder collection container is turned to the position to cover the attachment part of the apparatus body while opening the cover; and a container-side opening/closing mechanism having a container opening/closing lid that linearly moves to open and close a collection port provided in a predetermined receiving portion of the collection container along the longitudinal direction, the container-side opening/closing mechanism opening the collection port by moving the container opening/closing lid in cooperation with an operating member provided in the transport pipe when the powder collection container is turned to the position to cover the attachment part of the apparatus body, wherein the discharging port of the pipe-side opening/closing mechanism is disposed on an opposite side of a vertical line than the apparatus body, the vertical line extending through the pivot center of the powder collection container.

2. The powder collection device according to claim 1, wherein the opening/closing lid of the pipe-side opening/closing mechanism includes a communicating port that is larger than the discharging port and smaller than the collection port of the powder collection container and communicates between the discharging port and the collection port when the discharging port is opened, and an arm portion projecting downward on a side closer to the apparatus body than the communicating port, and wherein, when the powder collection container is attached to the attachment part, the operating member provided in the powder collection container first comes into contact with the arm portion.

3. The powder collection device according to claim 1, wherein the powder collection container has an elastically deformable elastic member that projects along a peripheral edge of the collection port.

4. A powder collection device comprising:

a first transport pipe that transports collected powder produced in an apparatus body includes a powder processing unit and a cover that is pivotally fixed to the apparatus body;

a second transport pipe disposed above the first transport pipe to transport collected powder produced in the apparatus body including the powder processing unit;

a powder collection container having, therein, a powder receiving chamber that receives the collected powder, supported turnably on a pivot center provided in a lower edge portion of an attachment part of the apparatus body, and removably attached to a position to cover the attachment part of the apparatus body;

a first pipe-side opening/closing mechanism having a first opening/closing lid that linearly moves to open and close a first discharging port provided on a bottom side of the first transport pipe near a protruding end in a longitudinal direction along the longitudinal direction of the first transport pipe, the first pipe-side opening/closing mechanism opening the first discharging port by moving the first opening/closing lid in cooperation with an operating member provided in the powder collection container when the powder collection container is turned to the position to cover the attachment part of the apparatus body while opening the cover;

a second pipe-side opening/closing mechanism having a second opening/closing lid that moves along an outer periphery of the second transport pipe to open and close a second discharging port provided on a bottom side of the second transport pipe near a protruding end in the longitudinal direction along the longitudinal direction of the second transport pipe, the second pipe-side opening/closing mechanism opening the second discharging port by moving the second opening/closing lid in cooperation with a second operating member provided in the powder collection container when the powder collection container is turned to the position to cover the attachment part of the apparatus body;

a first container-side opening/closing mechanism having a first container opening/closing lid that linearly moves to open and close a first collection port provided in a predetermined receiving portion of the powder collection container along the longitudinal direction of the first transport pipe, the first container-side opening/closing mechanism opening the first collection port by moving the first container opening/closing lid in cooperation with an operating member provided in the first transport pipe when the powder collection container is turned to the position to cover the attachment part of the apparatus body; and a second container-side opening/closing mechanism having a second container opening/closing lid that opens and closes a second collection port provided in a predetermined receiving portion above the first container-side opening/closing mechanism of the powder collection container, the second container-side opening/closing mechanism opening the second collection port by moving the second container opening/closing lid in cooperation with an operating member provided in the second transport pipe when the powder collection container is turned to the position to cover the attachment part of the apparatus body, wherein the first discharging port of the first pipe-side opening/closing mechanism is disposed on an opposite side of a vertical line than the apparatus body, the vertical line extending through the pivot center of the powder collection container.

5. The powder collection device according to claim 4, wherein the second discharging port is disposed at a position out of a region occupied by the first discharging port in a vertical direction.

6. The powder collection device according to claim 5, wherein the second discharging port is disposed on the vertical line including the pivot center.

7. The powder collection device according to claim 4, wherein the first opening/closing lid includes a communicating port that is larger than the first discharging port and smaller than the first collection port of the powder collection container and communicates between the first discharging port and the first collection port when the first discharging port is opened, and an arm portion projecting downward on a side closer to the apparatus body than the communicating port, and wherein, when the powder collection container is attached to the attachment part, the operating member provided in the powder collection container first comes into contact with the arm portion.

8. The powder collection device according to claim 4, wherein the powder collection container includes an elastically deformable elastic member projecting along a peripheral edge of the first collection port.

9. A processing apparatus comprising:

the powder processing unit provided in the apparatus body to process powder; and the powder collection device according to claim 1 that collects processed collected powder processed by the powder processing unit.

10. A processing apparatus comprising:

the powder processing unit provided in the apparatus body to process powder; and the powder collection device according to claim 4 that collects processed collected powder processed by the powder processing unit.

11. The processing apparatus according to claim 9, wherein the powder processing unit includes:

an image bearing member that bears an electrostatic latent image;

a developing device that develops the electrostatic latent image on the image bearing member with developer serving as the powder;

a transfer device that transfers a visible image developed by the developing device onto a recording material; and a cleaning device that cleans off residual developer remaining on the image bearing member, and wherein the powder collection device collects waste developer discharged from at least one of the developing device, the transfer device, and the cleaning device.

12. The processing apparatus according to claim 10, wherein the powder processing unit includes:

an image bearing member that bears an electrostatic latent image;

a developing device that develops the electrostatic latent image on the image bearing member with developer serving as the powder;

a transfer device that transfers a visible image developed by the developing device onto a recording material; and a cleaning device that cleans off residual developer remaining on the image bearing member, and wherein the powder collection device collects waste developer discharged from at least one of the developing device, the transfer device, and the cleaning device.

* * * * *